US009925792B2

(12) United States Patent
Aoki et al.

(10) Patent No.: US 9,925,792 B2
(45) Date of Patent: Mar. 27, 2018

(54) LIQUID DISCHARGE HEAD, LIQUID DISCHARGE APPARATUS, AND LIQUID DISCHARGE METHOD

(71) Applicant: CANON KABUSHIKI KAISHA, Tokyo (JP)

(72) Inventors: Takatsuna Aoki, Yokohama (JP); Seiichiro Karita, Saitama (JP); Shingo Okushima, Kawasaki (JP); Eisuke Nishitani, Tokyo (JP); Yumi Komamiya, Kawasaki (JP); Kazuhiro Yamada, Yokohama (JP); Zentaro Tamenaga, Sagamihara (JP); Noriyasu Nagai, Tokyo (JP); Tatsurou Mori, Yokohama (JP); Shuzo Iwanaga, Kawasaki (JP); Akio Saito, Tokyo (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/389,301

(22) Filed: Dec. 22, 2016

(65) Prior Publication Data

US 2017/0197434 A1 Jul. 13, 2017

(30) Foreign Application Priority Data

Jan. 8, 2016 (JP) ..... 2016-002950
Dec. 9, 2016 (JP) ..... 2016-239370

(51) Int. Cl.
*B41J 2/18* (2006.01)
*B41J 2/175* (2006.01)

(52) U.S. Cl.
CPC ..... *B41J 2/18* (2013.01); *B41J 2/17596* (2013.01)

(58) Field of Classification Search
CPC ..... B41J 2/18; B41J 2/17596
See application file for complete search history.

(56) References Cited

U.S. PATENT DOCUMENTS

2005/0259127 A1 11/2005 Enomoto
2010/0238238 A1 9/2010 Yamamoto
(Continued)

FOREIGN PATENT DOCUMENTS

EP 0575983 A2 12/1993
JP 2002-533247 A 10/2002
(Continued)

*Primary Examiner* — Lamson Nguyen
(74) *Attorney, Agent, or Firm* — Canon U.S.A., Inc. IP Division

(57) ABSTRACT

A liquid discharge head includes discharge orifices, recording elements that generate energy, supply channels that supply liquid to the recording elements, a common supply channel communicating with the supply channels, recovery channels that recover liquid supplied to the recording elements, a common recovery channel that recovers liquid from the recovery channels, a first inlet port that supplies liquid to the common supply channel, a first recovery port that recovers liquid from the first common supply channel, a second inlet port that supplies liquid to the common recovery channel, and a second recovery port that recovers liquid from the second common recovery channel. The first inlet port and the first recovery port communicate without going through channel portions where recording elements are disposed, and the second inlet port and the second recovery port communicate without going through channel portions where recording elements are disposed.

37 Claims, 34 Drawing Sheets

(56) References Cited

U.S. PATENT DOCUMENTS

| | | | | |
|---|---|---|---|---|
| 2012/0026242 | A1* | 2/2012 | Igarashi | B41J 2/175 347/33 |
| 2012/0160925 | A1 | 6/2012 | Hoisington | |
| 2013/0271529 | A1 | 10/2013 | Domae | |
| 2013/0286116 | A1* | 10/2013 | Takahashi | B41J 2/18 347/92 |
| 2017/0197412 | A1* | 7/2017 | Kasai | B41J 2/1433 |

FOREIGN PATENT DOCUMENTS

| | | | |
|---|---|---|---|
| JP | 2008-142910 | A | 6/2008 |
| WO | 2013/002775 | A1 | 1/2013 |

* cited by examiner

LIQUID DISCHARGE HEAD, LIQUID DISCHARGE APPARATUS, AND LIQUID DISCHARGE METHOD

BACKGROUND

Field

The present disclosure relates to a liquid discharge head that discharges liquid such as ink or the like, a liquid discharge apparatus, and a liquid discharge method.

Description of the Related Art

An inkjet recording head that performs recording by discharging a liquid such as ink or the like is representative of liquid discharge heads. In liquid discharge heads, volatile components in ink contained in the head evaporates from discharge orifices. This changes the concentration of color material in the ink near the discharge orifices, which is problematic in that unevenness of color occurs in images being recorded, viscosity increases near the discharge orifices, changing the speed of droplets being discharged, and droplet landing accuracy deteriorates, and so forth. A method is known to counter these problems, in which ink supplied to the liquid discharge head is circulated over a circulation path.

Japanese Patent Laid-Open No. 2008-142910 discloses an apparatus that prevents thickening of ink near discharge orifices that are in a state of not performing discharging by circulating ink. Further, PCT Japanese Translation Patent Publication No. 2002-533247 discloses an apparatus that cleans within a chamber by circulating ink.

However, the invention described in Japanese Patent Laid-Open No. 2008-142910 has a configuration where ink that has flowed into a head 11 from a first tank 12 passes through pressure chambers where piezoelectric elements have been disposed, and is recovered from the head 11, as illustrated in FIG. 7 of Japanese Patent Laid-Open No. 2008-142910. Moreover, the invention described in PCT Japanese Translation Patent Publication No. 2002-533247 has a configuration where ink that has flowed into a head 2010 from a lower container 2050 passes through chambers for discharging, and is recovered from the head 2010, as illustrated in FIGS. 4, 5, and 8 of PCT Japanese Translation Patent Publication No. 2002-533247.

Thus, the circulation configurations disclosed in both Japanese Patent Laid-Open No. 2008-142910 and PCT Japanese Translation Patent Publication No. 2002-533247 both involve ink that has flowed into the head passing through pressure chambers and being recovered from the head. In a case where the flow rate of circulation is increased, for example, in such a configuration, the ink passes through pressure chambers where the cross-sectional area is relatively smaller than the cross-sectional are of other channel portions, so the channel resistance is large at that portion, and pressure drop in the circulatory flow increases. The channel resistance at that portion can be reduced by enlarging the cross-sectional area of the pressure chambers, but larger pressure chambers affect discharge of ink, and further increase the size of the head.

SUMMARY

It has been found desirable to provide a liquid discharge head, a liquid discharge apparatus, and a liquid discharge method, capable of supplying liquid into the liquid discharge head while suppressing pressure drop due to supplying of the liquid.

A liquid discharge head includes: a plurality of discharge orifices configured to discharge liquid; a plurality of recording elements configured to generate energy used to discharge liquid; a plurality of supply channels configured to supply liquid to the plurality of recording elements; a common supply channel communicating with the plurality of supply channels and configured to supply liquid to the plurality of supply channels; a plurality of recovery channels configured to recover liquid supplied to the plurality of recording elements by the plurality of supply channels; and a common recovery channel communicating with the plurality of recovery channels and configured to recover liquid from the plurality of recovery channels. The liquid discharge head has formed therein a first inlet port configured to supply liquid from outside of the liquid discharge head to the common supply channel, and a first recovery port configured to recover liquid from the common supply channel to the outside of the liquid discharge head. The first inlet port and the first recovery port communicate by the common supply channel without going through channel portions where the recording elements are disposed. The liquid discharge head has formed therein a second inlet port configured to supply liquid from outside of the liquid discharge head to the common recovery channel, and a second recovery port configured to recover liquid from the common recovery channel to the outside of the liquid discharge head. The second inlet port and the second recovery port communicate by the common recovery channel without going through channel portions where the recording elements are disposed.

A liquid discharge apparatus includes: a liquid discharge head including a plurality of discharge orifices configured to discharge liquid, a plurality of recording elements configured to generate energy used to discharge liquid, a first common channel communicating with a first inlet port and a first recovery port, a plurality of first individual channels communicating with the first common channel and configured to supply liquid to the plurality of recording elements, a second common channel communicating with a second inlet port and a second recovery port, a plurality of second individual channels communicating with the second common channel and configured to recover liquid in the pressure chambers to the second recovery channel; and a supply unit configured supply liquid to the first common channel, the first individual channels, the plurality of recording elements, the second individual channels, and the second common channel. The first inlet port and the first recovery port communicate with the first common channel without going through the pressure chamber, and the second inlet port and the second recovery port communicate with the second common channel without going through the pressure chamber.

A liquid discharge method is a liquid discharge method of discharging liquid from a liquid discharge head that includes a plurality of discharge orifices configured to discharge liquid, a plurality of recording elements configured to generate energy used to discharge liquid, a plurality of supply channels configured to supply liquid to the plurality of recording elements, a common supply channel communicating with the plurality of supply channels and configured to supply liquid to the plurality of supply channels, a plurality of recovery channels configured to recover liquid supplied to the plurality of recording elements by the plurality of supply channels, a common recovery channel communicating with the plurality of recovery channels and configured to recover liquid from the plurality of recovery channels, a first inlet port configured to supply liquid from outside of the liquid discharge head to the common supply channel, a first recovery port configured to recover liquid from the common supply channel to the outside of the liquid discharge head, a second inlet port configured to supply liquid from outside of the liquid discharge head to the common recovery channel, and a second recovery port configured to recover liquid from the common recovery channel to the outside of the liquid discharge head. The method includes: recovering liquid that has flowed from the first input port into the common supply channel to the outside of the liquid discharge head from the first recovery port, and also recovering liquid that has flowed from the second input port into the common recovery channel to the outside of the liquid discharge head from the second recovery port; and discharging liquid from the discharge orifices in a state where supply of liquid is being performed in the recovering.

Further features will become apparent from the following description of exemplary embodiments with reference to the attached drawings.

DESCRIPTION OF THE EMBODIMENTS

A liquid discharge head, liquid discharge apparatus, and liquid discharge method according to embodiments will be described below with reference to FIGS. 1 through 18. Note that the embodiments of the liquid discharge head and liquid discharge apparatus are applicable to apparatuses such as printers, photocopiers, facsimile devices having communication systems, word processors having printer units, and so forth, and further to industrial recording apparatuses combined in a complex manner with various types of processing devices. For example, the exemplary embodiments can be used in fabricating biochips, printing electronic circuits, and other such usages. Although a thermal system where a heat-generating element generates bubbles to discharge a liquid is employed in the following embodiments, the disclosure can be applied to liquid discharge heads employing other liquid discharge system, such as a piezoelectric system and so forth.

Although the liquid discharge apparatus according to embodiments relate to an inkjet recording apparatus (or simply "recording apparatus") of a form where a liquid such as ink or the like is circulated between an ink tank and liquid discharge head, other forms may be used as well. For example, a form may be employed where, instead of circulating ink, two ink tanks are provided, one at the upstream side of the liquid discharge head and the other on the downstream side, and ink within the pressure chamber is caused to flow by running ink from one ink tank to the other.

Also, the liquid discharge head according to embodiments relate to a so-called line head that has a length corresponding to the width of the recording medium, but the embodiments can also be a so-called serial liquid discharge head that records while scanning over the recording medium. An example of a serial liquid discharge head is a configuration that has one board each for recording black ink and for recording color ink, for example. However, this is not restrictive, and an arrangement may be made where short line heads that are shorter than the width of the recording medium are formed, with multiple recording element boards arrayed so that orifices overlap in the discharge orifice row direction, these being scanned over the recording medium.

Thus, the embodiments that are described below are suitable specific examples of the present invention, and accordingly various limitations that are technically preferable are applied, but the present invention is not restricted to the embodiments in the present specification or any other specific methods, as long as within the technical idea of the present invention.

First Embodiment

Description of Inkjet Recording Apparatus

Figure 1:
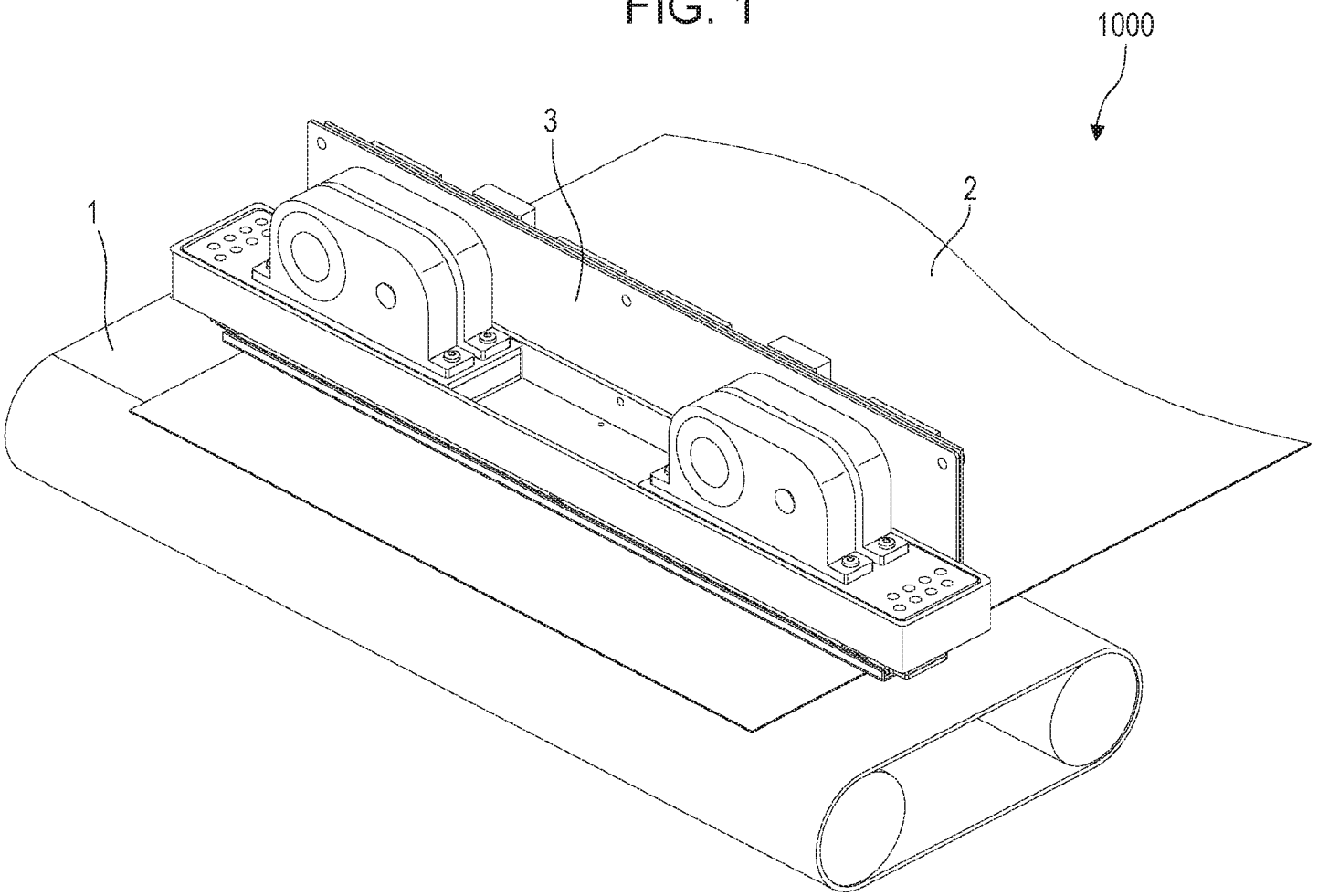
FIG. 1 is a perspective view schematically illustrating inside of a recording apparatus that is a first example of a liquid discharge apparatus according to an exemplary embodiment.

FIG. 1 illustrates a schematic configuration of a liquid discharge apparatus, and more particularly an inkjet recording apparatus 1000 (hereinafter also referred to simply as "recording apparatus") that performs recording by discharging ink. The recording apparatus 1000 has a conveyance unit 1 that conveys a recording medium 2, and a line type (page-wide type) liquid discharge head 3 disposed generally orthogonal to the conveyance direction of the recording medium 2, and performs single-pass continuous recording while continuously or intermittently conveying multiple recording mediums 2. The recording medium 2 is not restricted to cut sheets, and may be continuous roll sheets. The liquid discharge head 3 is capable of full-color printing by cyan, magenta, yellow, and black (acronym "CMYK") ink. Connected to this are a liquid supply unit serving as a supply channel that supplies ink to the liquid discharge head 3, and two ink tanks (a main tank and a buffer tank) (see FIG. 2), in fluid connection. The liquid discharge head 3 is also electrically connected to an electric control unit that transmits electric power and discharge control signals to the liquid discharge head 3. Liquid paths and electric signal paths within the liquid discharge head 3 will be described later.

Description of Structure of Recording Element Board

Figure 19A:
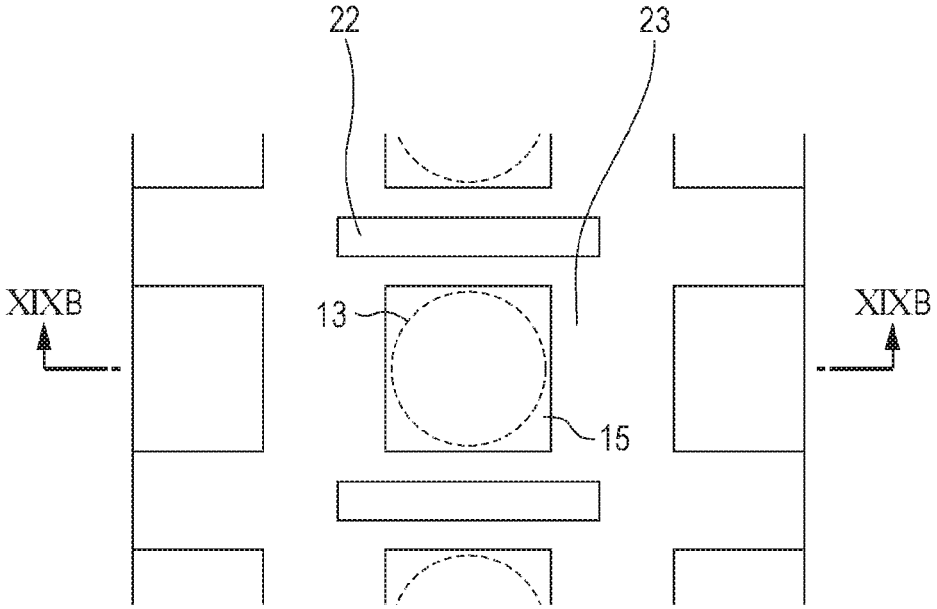
FIGS. 19A and 19B are diagrams illustrating the configuration of a liquid discharge head according to an exemplary embodiment.
Figure 19B:
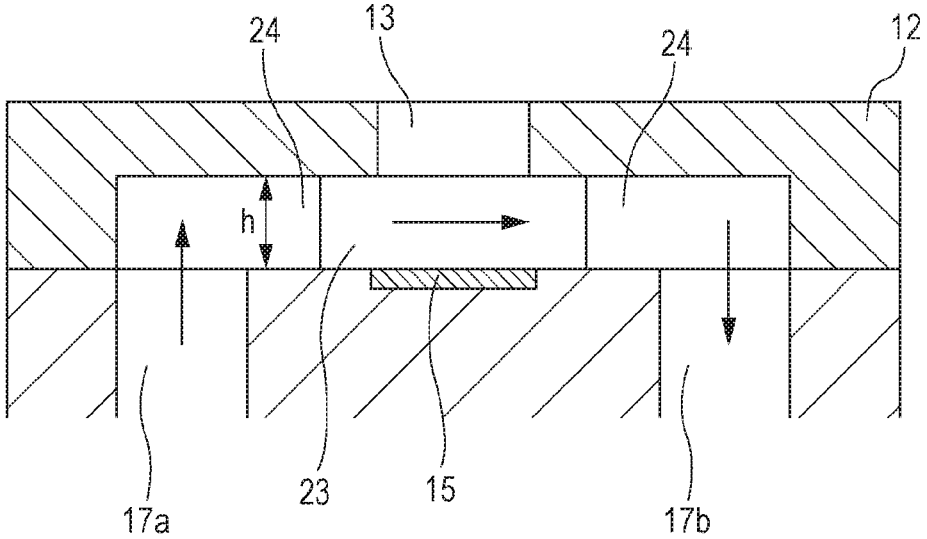

FIGS. 19A and 19B are diagrams for describing a configuration example of a liquid discharge head that discharges liquid such as ink. FIG. 19A is a plan view of a recording element board 10 of the liquid discharge head on which a discharge orifice 13 is formed, and FIG. 19B is a cross-sectional diagram taken along line XIXB-XIXB in FIG. 19A. A recording element 15 is provided on the recording element board 10 to generate energy used to discharge liquid, as illustrated in FIG. 19A. Further, an individual supply channel 17*a* that supplies ink to the pressure chamber 23 containing the recording elements 15, and an individual recovery channel 17*b* that recovers ink within the pressure chamber 23, are formed in the recording element board 10. The discharge orifice 13 that discharges ink is formed in a discharge orifice forming member 12, which is one member making up the recording element board 10. Although the recording element 15 will be described in the present specification as a heater that is a heat-generating element capable of generating thermal energy, but the embodiments are not restricted to this. Various types of recording elements that generate energy for discharge, such as electromechanical conversion elements like piezoelectric elements, or the like, may be employed.

It can be understood from FIGS. 19A and 19B that multiple individual supply channels 17*a* and individual recovery channels 17*b* are formed on the recording element board 10, with multiple pressure chambers 23 formed therebetween. The pressure chambers 23 are sectioned by walls 22. A recording element 15 is disposed inside each pressure chamber 23, and a discharge orifice 13 is formed at a position facing the recording element 15. Recording elements 15 are selectively driven in accordance with recording data, and a desired amount of ink is discharged from the discharge orifices 13. In a case where the recording elements 15 are not being driven, the ink is supplied from the individual supply channels 17*a* to the pressure chambers 23, and then recovered from the recording element board 10 via the individual recovery channels 17*b*. This flow of ink (circulatory flow) is occurring even when the recording elements 15 are not being driven, and further, the circulatory flow continues to occur even while the recording elements 15 are being driven to discharge ink. That is to say, the recording elements 15 are driven and ink is discharged in a state where ink is flowing through the pressure chambers 23. The recording elements 15 are electrically connected with terminals 16 illustrated in FIG. 13A by wiring (omitted from illustration) provided to the recording element board 10. The recording elements 15 generate heat and boil the liquid based on pulse signals from a control circuit of the recording apparatus 1000, input via an electric wiring board 90 (FIG. 4) and flexible printed circuit board 40 (FIG. 8B). The liquid is discharged from the discharge orifices 13 by the force of bubbling due to this boiling.

Description of Circulation Configuration

Thus, in a system where heat is transmitted to ink by driving the recording elements 15, the temperature distribution within the head stabilizes when the recording elements 15 are in a stopped state, of after a certain amount of time has elapsed after having been driven. However, the situation is different when in a transient state, with the temperature of ink inside the pressure chambers 23 changing from moment to moment in the transient state since heat from the recording elements 15 is transmitted to the ink according to a certain time constant, so discharge properties also change. Accordingly, the temperature nearby the pressure chambers 23 is monitored, and if determination is made that the temperature is equal to or lower than a predetermined threshold value, a heat source (omitted from illustration) to heat the recording elements 15 or pressure chambers 23 is driven to a level where the ink does not boil. Accordingly, the ink temperature within the pressure chamber 23 can be maintained within the set range, and unevenness in discharge properties can be suppressed.

Figure 2:
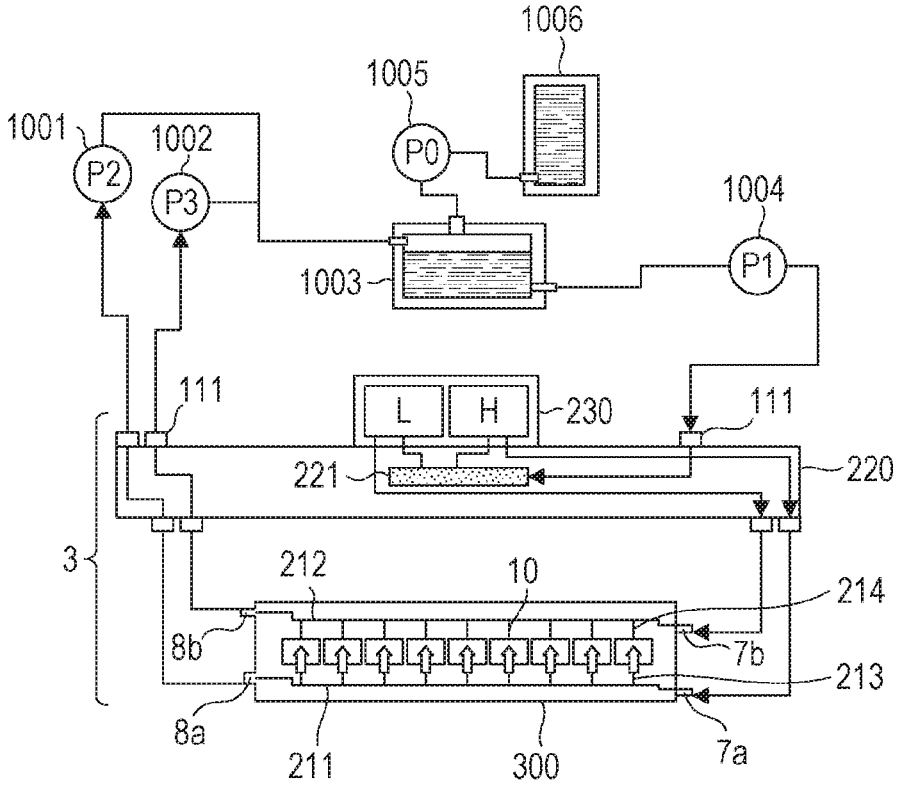
FIG. 2 is a diagram illustrating a channel configuration of a liquid discharge apparatus according to a first embodiment.

The liquid discharge head 3 according to the first embodiment will be described with reference to FIGS. 1 through 8B. FIG. 2 illustrates an example of the overall configuration of the channel system in the recording apparatus that is an example of the liquid discharge apparatus according to the present embodiment. FIG. 2 is a schematic diagram illustrating a first circulation path that is a first form of a circulation path applied to the recording apparatus of the present embodiment. FIG. 2 is a diagram illustrating the liquid discharge head 3 connected to a first circulation pump (high-pressure side) 1001, a first circulation pump (low-pressure side) 1002 and a buffer tank 1003 and the like connected by fluid connection. Although FIG. 2 only illustrates the paths over which one color ink flows, for the sake of brevity of description, in reality there are circulation paths provided to the liquid discharge head 3 and the recording apparatus main unit for as many colors as necessary. The buffer tank 1003, serving as a sub-tank that is connected to a main tank 1006, has an atmosphere communication opening (omitted from illustration) whereby the inside and the outside of the tank communicate, and bubbles within the ink can be discharged externally. The buffer tank 1003 is also connected to a replenishing pump 1005. When ink is consumed at the liquid discharge head 3 by discharging (ejecting) ink from the discharge orifices of the liquid discharge head 3, by discharging ink to perform recording, suction recovery, or the like, the replenishing pump 1005 acts to send ink of an amount the same as that has been consumed from the main tank 1006 to the buffer tank 1003.

The first circulation pumps 1001 and 1002 act to suction liquid from a liquid connector 111 and flow the ink to the buffer tank 1003. The first circulation pumps 1001 and 1002 preferably are positive-displacement pumps that have quantitative liquid sending capabilities. Specific examples may include tube pumps, gear pumps, diaphragm pumps, syringe pumps, and so forth. An arrangement may also be used where a constant flow is ensured by disposing a common-use constant-flow value and relief valve at the outlet of the pump. When the liquid discharge head 3 is being driven, the (high-pressure side) 1001 and first circulation pump (low-pressure side) 1002 cause a constant amount of ink to flow through a common supply channel 211 and a common recovery channel 212.

A negative pressure control unit 230 is provided on a path between a second circulation pump 1004 and the liquid discharge unit 300. Accordingly, the negative pressure control unit 230 functions such that the pressure downstream from the negative pressure control unit 230 (i.e., at the liquid discharge unit 300 side) can be maintained at a present constant pressure even in cases where the flow rate of the circulation system fluctuates due to difference in duty when recording. Any mechanism may be used as two pressure adjustment mechanisms making up the negative pressure control unit 230, as long as pressure downstream from itself can be controlled to fluctuation within a constant range or smaller that is centered on a desired set pressure. As one example, a mechanism equivalent to a so-called "pressure-reducing regulator" can be employed. This configuration enables the effects of water head pressure as to the liquid discharge head 3 of the buffer tank 1003 as to the liquid discharge head 3 to be suppressed, giving broader freedom in the layout of the buffer tank 1003 in the recording apparatus 1000.

It is sufficient that the second circulation pump 1004 have a certain lift pressure or greater, within the range of the circulatory flow pressure of ink used when driving the liquid discharge head 3, and turbo pumps, positive-displacement pumps, and the like can be employed. Specifically, diaphragm pumps or the like can be used. Alternatively, a water head tank disposed with a certain water head difference as to the negative pressure control unit 230, for example, may be employed instead of the second circulation pump 1004. By thus integrating the pumps supplying ink to the liquid discharge head 3, the number of pumps of the entire apparatus can be reduced, and the apparatus size can be reduced.

As illustrated in FIG. 2, the negative pressure control unit 230 has two pressure adjustment mechanisms, with different control pressure from each other having been set. Of the two negative pressure adjustment mechanisms, the relatively high-pressure setting side (denoted by H in FIG. 2) and the relatively low-pressure setting side (denoted by L in FIG. 2) are respectively connected to the common supply channel 211 and the common recovery channel 212 within the liquid discharge unit 300 via the liquid supply unit 220. Provided to the liquid discharge unit 300 are branch supply channels 213 and branch recovery channels 214 communicating between the common supply channel 211, common recovery channel 212, and the recording element boards 10. A first inlet port 7*a* and a first recovery port 8*a* are formed at the common supply channel 211. The first inlet port 7*a* is connected to a pressure adjustment mechanism H, and the first recovery port 8*a* is connected to the first circulation pump (first recovery pump) 1001, each in by fluid connection. A second inlet port 7*b* and a second recovery port 8*b* are formed at the common recovery channel 212. The second inlet port 7*b* is connected to the pressure adjustment mechanism L, and the second recovery port 8*b* is connected to the first circulation pump (second recovery pump) 1002, each by fluid connection. The following Inequalities are satisfied $$Pu_i > Pd_i \qquad \text{Inequality 1}$$

$$Pu_o > Pd_o \qquad \text{Inequality 2}$$

where Pu_i represents the pressure value near the first inlet port 7*a* in the common supply channel 211, Pu_o represents the pressure value near the first recovery port 8*a*, Pd_i represents the pressure value near the second inlet port 7*b* of the common recovery channel 212, and Pd_o represents the pressure value near the second recovery port 8*b*.

The pressure adjustment mechanism H is connected to the common supply channel 211 and the pressure adjustment mechanism L to the common recovery channel 212, so differential pressure is generated between the two common channels, satisfying Inequality 1. Also, a certain amount of ink satisfying Inequality 2 is flowing through the interior of the common supply channel 211 and the common recovery channel 212 by the first circulation pumps 1001 and 1002.

According to this configuration, a flow of ink as to each recording element board 10 is generated, from the common supply channel 211 passing through the branch supply channels 213, the multiple pressure chambers 23 within the recording element board 10 the branch recovery channels 214, and to the common recovery channel 212 (the outline arrows in FIG. 2). Further, a flow occurs at the same time where ink supplied form the two inlet ports is recovered to the respective common channels without going through the recording element boards 10. Accordingly, even in a case where a relatively large flow rate of ink is supplied, increase of pressure drop at the supply path within the liquid discharge head 3 can be suppressed, and an ink flow can be generated in pressure chambers 23 where discharge is not being performed. Thus, the heat generated at the recording element boards 10 can be externally discharged form the liquid discharge head 3 by the flows of the common supply channel 211 and common recovery channel 212. Also, ink flow can be generated at the discharge orifices 13 and pressure chambers 23 regardless of the operation state, so thickening of ink at these portions can be suppressed. Further, thickened ink and foreign substances in the ink can be discharged to the common recovery channel 212. Accordingly, the liquid discharge head 3 according to the present embodiment can record at high speed with high image quality.

Description of Configuration of Head

Figure 3A:
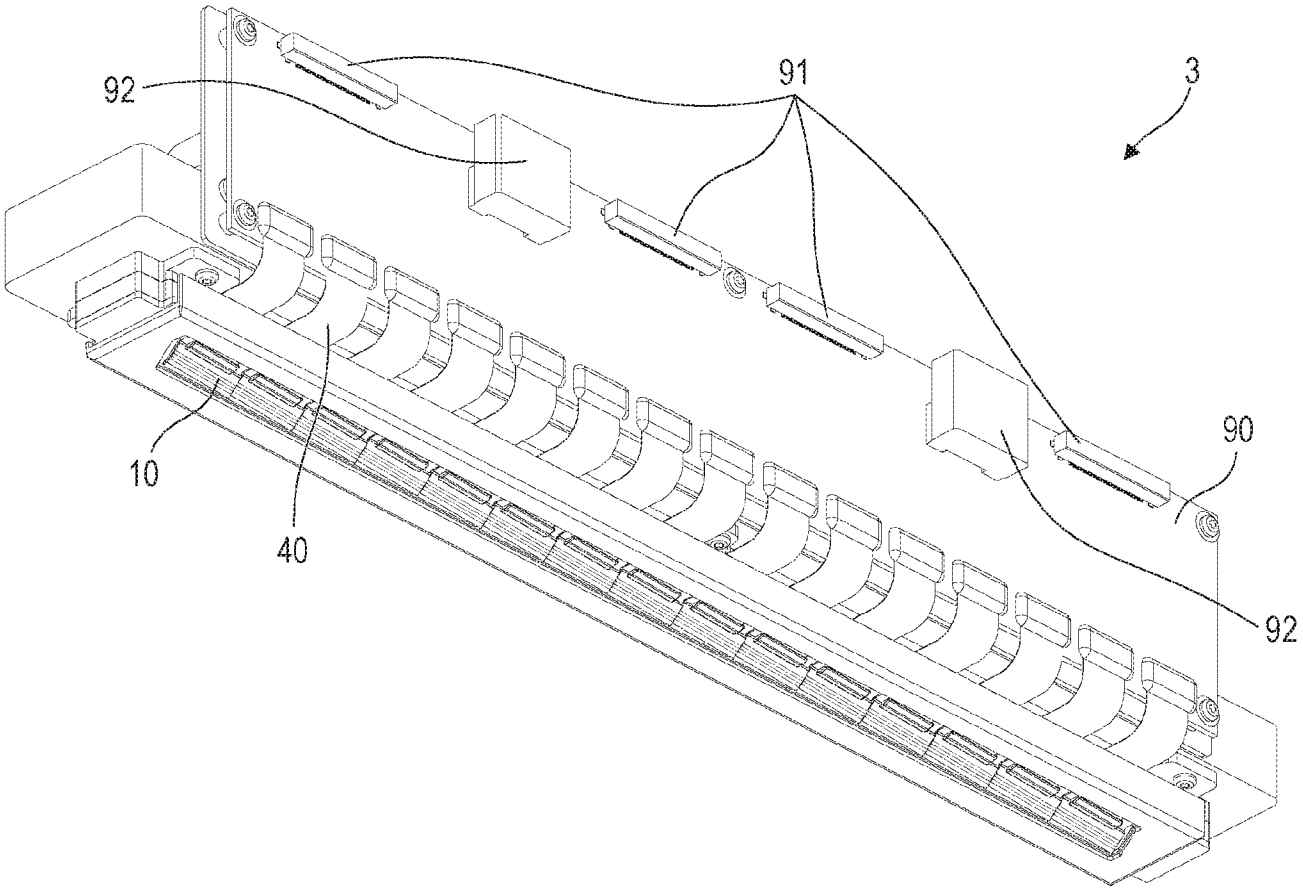
FIGS. 3A and 3B are perspective diagrams of the external appearance of a liquid discharge head according to the first embodiment.
Figure 3B:
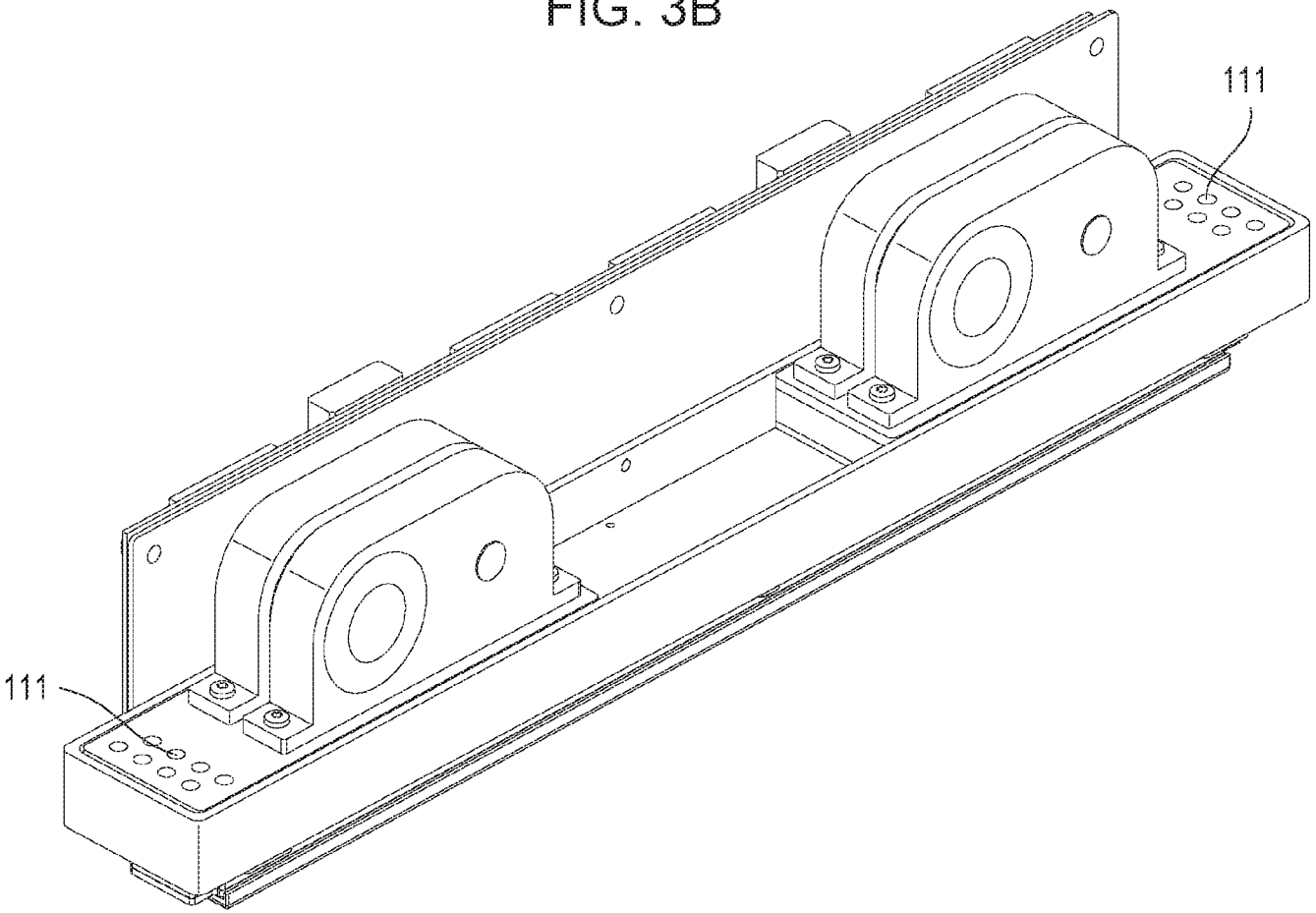

The configuration of the liquid discharge head 3 according to the first embodiment will be described. FIGS. 3A and 3B are perspective views of the liquid discharge head 3 according to the present embodiment. The liquid discharge head 3 is a line-type liquid discharge head where fifteen recording element boards 10 each capable of discharging ink of the four colors of C, M, Y, and K are arrayed on a straight line (inline layout). The liquid discharge head 3 includes the recording element boards 10, and input terminals 91 and power supply terminals 92 that are electrically connected via flexible printed circuit boards 40 and an electric wiring board 90, as illustrated in FIG. 3A. The input terminals 91 and power supply terminals 92 are electrically connected to a control unit of the recording apparatus 1000, and each supply the recording element boards 10 with discharge drive signals and electric power necessary for discharge. Consolidating wiring by electric circuits in the electric wiring board 90 enables the number of input terminals 91 and power supply terminals 92 to be reduced in comparison with the number of recording element boards 10. This enables the number of electric connection portions that need to be removed when assembling the liquid discharge head 3 to the recording apparatus 1000 or when exchanging the liquid discharge head 3. Liquid connection portions 111 provided to both ends of the liquid discharge head 3 are connected with the liquid supply system of the recording apparatus 1000, as illustrated in FIG. 3B. Thus, ink of the four colors of CMYK is supplied to the liquid discharge head 3, and ink that has passed through the liquid discharge head 3 is recovered to the supply system of the recording apparatus 1000. In this way, ink of each color can circulate over the path of the recording apparatus 1000 and the path of the liquid discharge head 3.

Figure 4:
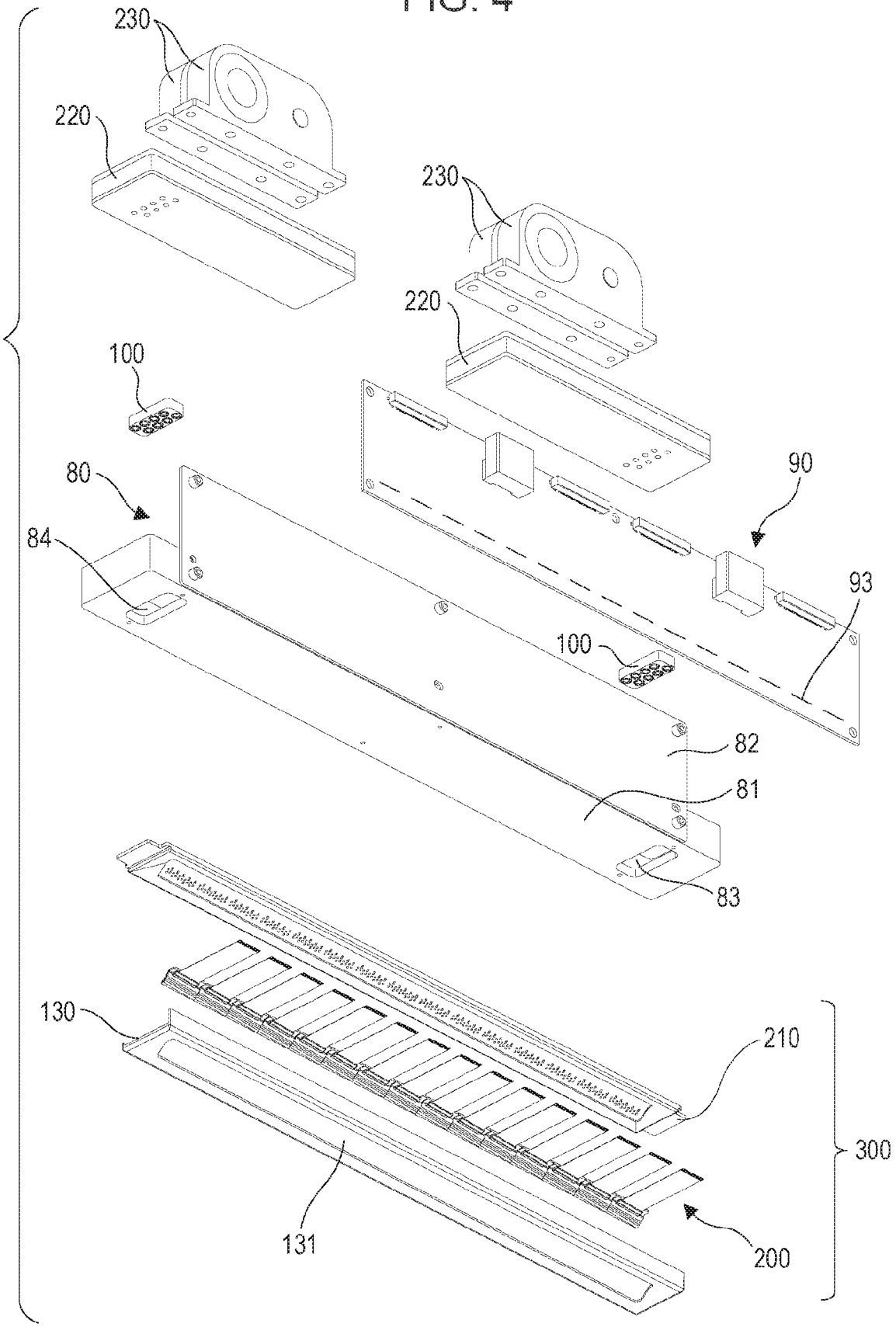
FIG. 4 is a disassembled perspective view of the liquid discharge head according to the first embodiment.

FIG. 4 illustrates a disassembled perspective view of parts and units making up the liquid discharge head 3. The liquid discharge unit 300, liquid supply units 220, and electric wiring board 90 are attached to a case 80. The liquid connection portions 111 (FIG. 3) are provided to the liquid supply unit 220, and filters 221 (FIGS. 2 and 3) for each color, that communicate with each opening of the liquid connection portions 111 to remove foreign substances in the supplied ink, are provided inside the liquid supply units 220. Two liquid supply units 220 are each provided with filters 221 for two colors. The inks that have passed through the filters 221 are supplied to the respective negative pressure control units 230 provided on the corresponding liquid supply units 220.

Figure 5A:
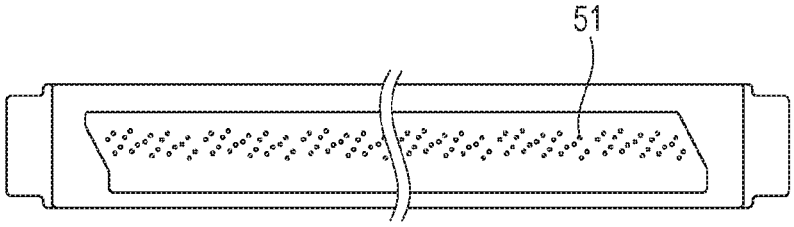
FIGS. 5A through 5E are cross-sectional views of channel members at various positions in the first embodiment.
Figure 5B:
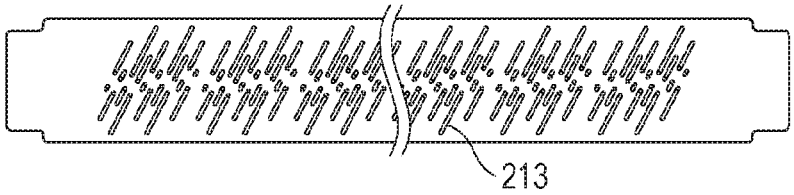
Figure 5C:
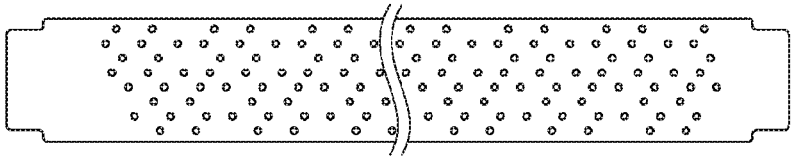
Figure 5D:
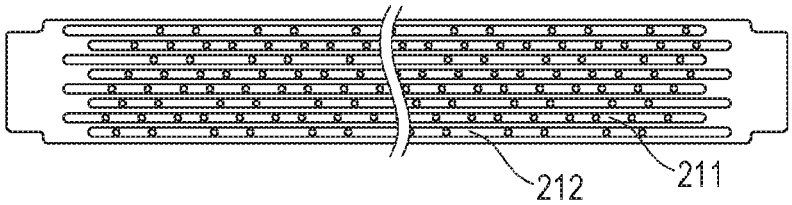
Figure 5E:
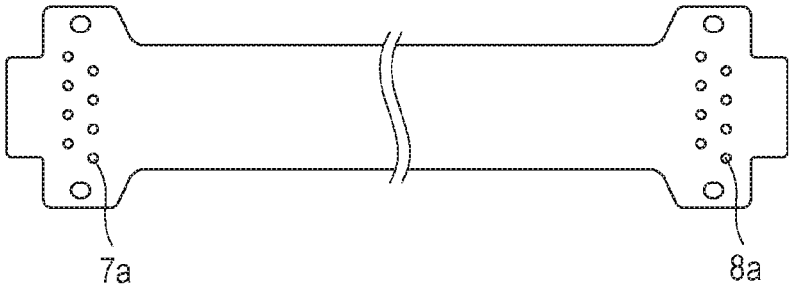

Next, description will be made regarding the configuration of the channel member 210 included in the liquid discharge unit 300. The channel member 210 is a channel member that distributes the liquid supplied from the liquid supply unit 220 to each of the discharge modules 200, and returns liquid recirculating from the discharge modules 200 to the liquid supply unit 220, as illustrated in FIG. 4. The channel member 210 is fixed to the liquid discharge unit support member 81 by screws, thereby suppressing warping and deformation of the channel member 210. FIGS. 5A through 5E are disassembled views to facilitate understanding of the channel portions of the channel member 210. FIG. 5A illustrates the side on which the discharge modules 200 are mounted, and FIG. 5E illustrates the face that comes in contact with the liquid discharge unit support member 81. The eight common channels extending in the longitudinal direction of the channel member are the common supply channel 211 and common recovery channel 212 for each color. Each inlet port 7 and each recovery port 8 communicate with the holes in the joint rubber members 100, so as to communicate with the liquid supply unit 220 by fluid connection. The channel member 210 further has multiple branch channels 213 formed in a direction intersecting the common channels, communicating with multiple discharge modules 200 by fluid connection. The channel member 210 preferably is corrosion-resistant as to the liquid, and formed from a material having a low linear expansion coefficient. Examples suitable materials include alumina, liquid crystal polymer (LCP), and composite materials (resin materials) where inorganic filler such as fine particles of silica or fiber or the like has been added to a base material such as polyphenyl sulfide (PPS) or polysulfone (PSF).

Figure 6:
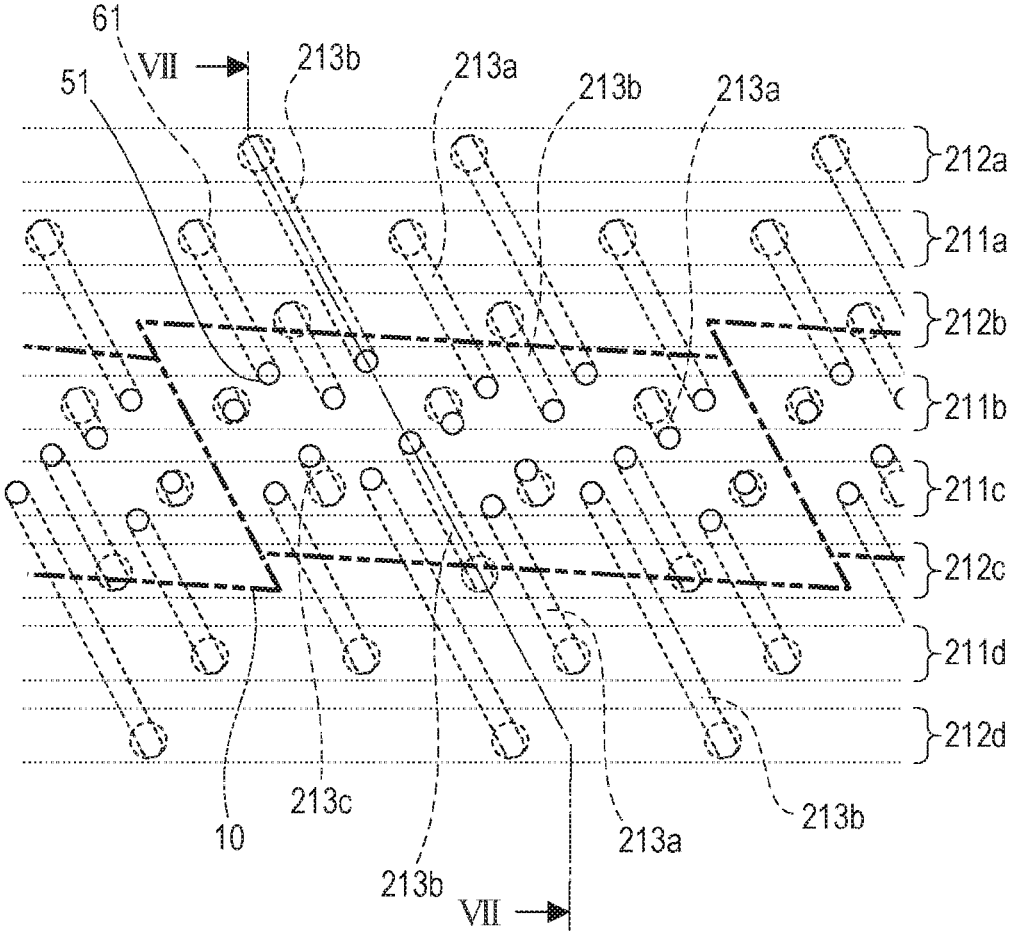
FIG. 6 is a transparent view of channel members in the first embodiment.

Next, the connection relationship of the channels within the channel member 210 will be described with reference to FIG. 6. FIG. 6 is a partially enlarged transparent view of channels within the channel member 210 as viewed from the side on which the discharge modules 200 are mounted. The channel member 210 has, for each color, common supply channels 211 (211*a*, 211*b*, 211*c*, and 211*d*) and common recovery channels 212 (212*a*, 212*b*, 212*c*, and 212*d*) extending on the longitudinal direction of the liquid discharge head 3. Branch supply channels 213 are connected to the common supply channels 211 of each color via the communication ports 61. Multiple branch recovery channels 214 are connected to the common recovery channels 212 of each color via the communication ports 61. This channel configuration enables ink to be consolidated at the recording element boards 10 situated at the middle of the channel members, from the common supply channels 211 via the branch supply channels 213. Ink can also be recovered from the recording element boards 10 to the common recovery channels 212 via the branch recovery channels 214.

Figure 7:
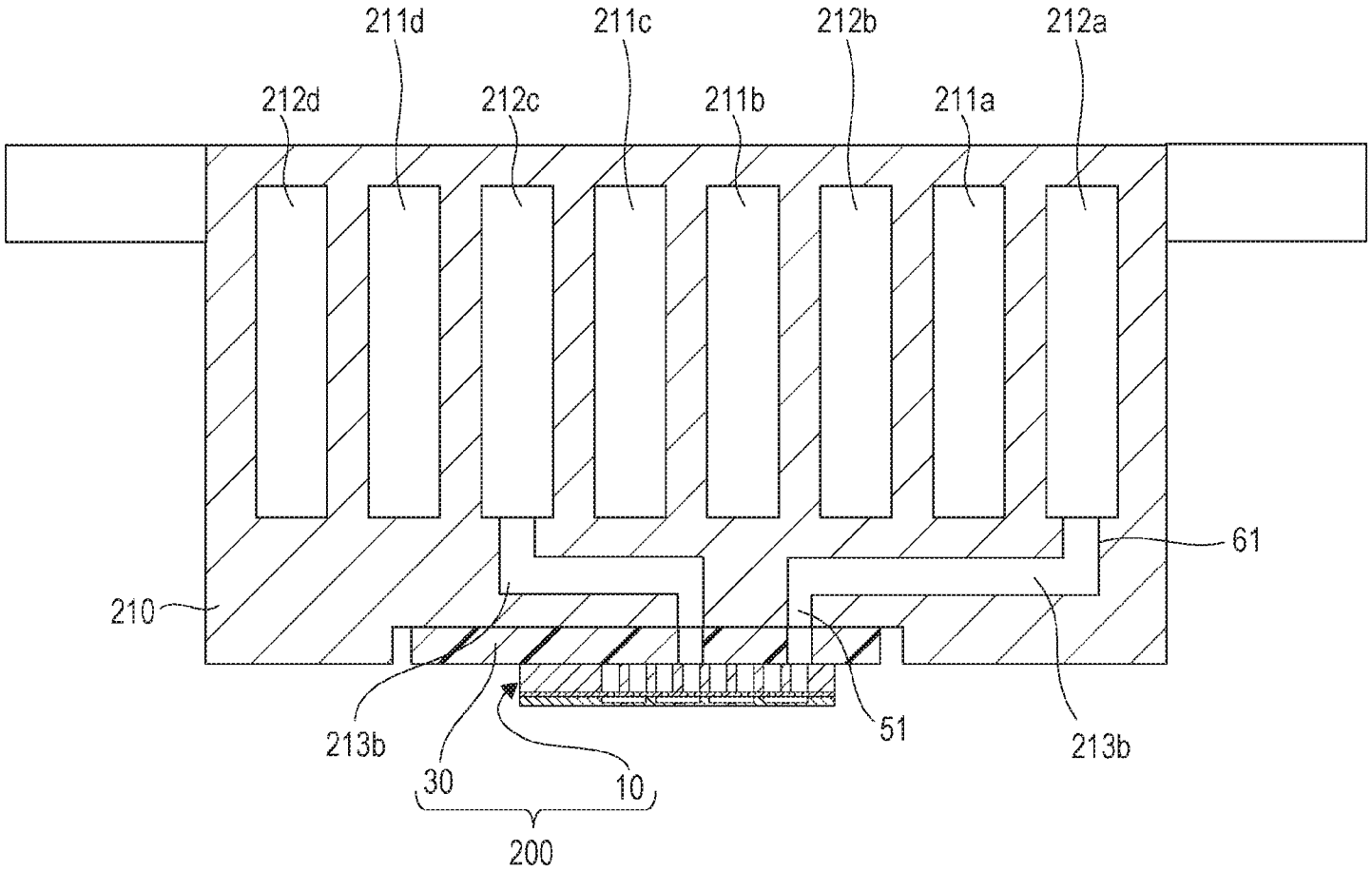
FIG. 7 is a cross-sectional view of the liquid discharge head according to the first embodiment.

FIG. 7 is a cross-sectional view taken along line VII-VII in FIG. 6, illustrating that the branch recovery channels 214 communicate with the discharge module 200. Although FIG. 7 only illustrates the branch recovery channels 214, the branch supply channels 213 and the discharge module 200 communicate at a different cross-section, as illustrated in FIG. 6. The recording element boards 10 included in each discharge module 200 have multiple individual supply channels 17*a* and multiple individual recovery channel 17*b* formed, with the branch supply channels 213 and individual supply channels 17*a*, and the branch recovery channels 214 and the individual recovery channels 17*b*, respectively being connected by fluid connection.

Figure 8A:
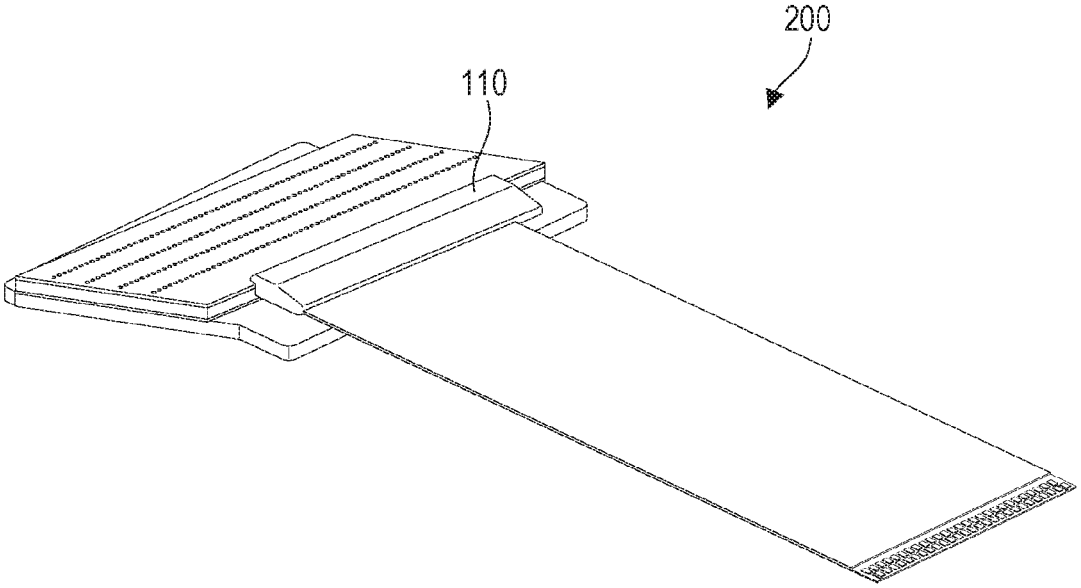
FIGS. 8A and 8B are diagrams illustrating a discharge module of the liquid discharge head 3 according to an exemplary embodiment, FIG. 8A being a perspective view and FIG. 8B a disassembled view.
Figure 8B:
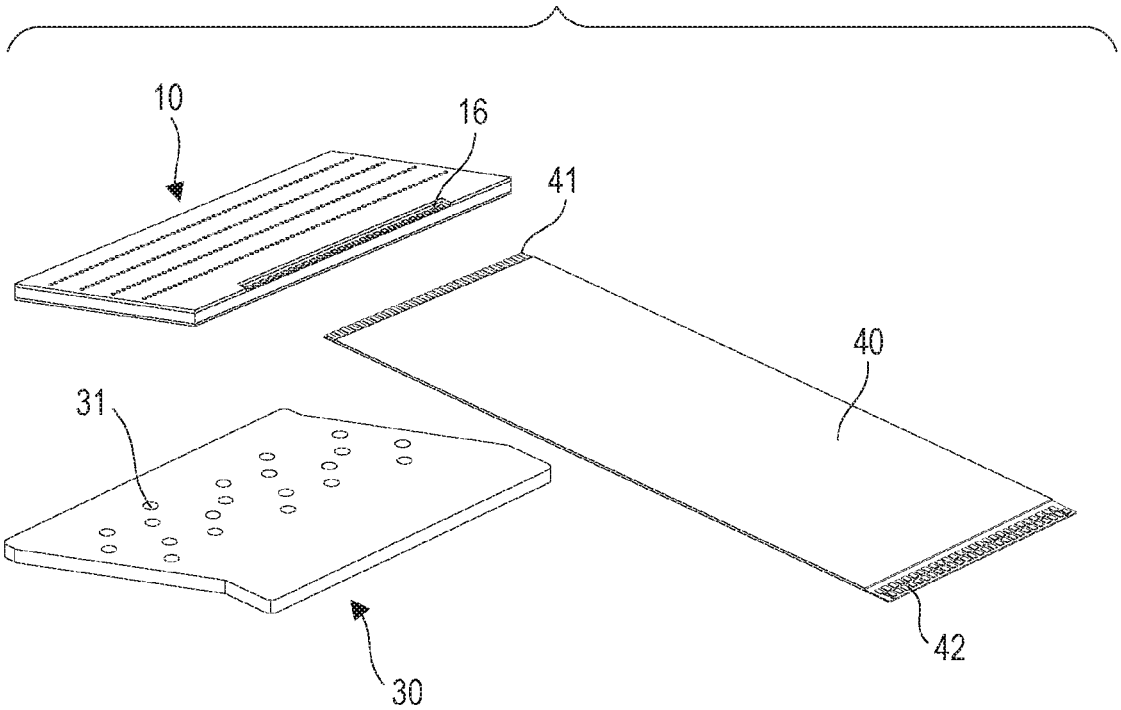

FIG. 8A illustrates a perspective view of one discharge module 200, and FIG. 8B illustrates a disassembled view thereof. Terminals 42 at the other end of the flexible printed circuit board 40 from the recording element board 10 are electrically connected to connection terminals 93 (FIG. 4) of the electric wiring board 90. The support member 30 is a support member that supports the recording element board 10, and also is a channel member communicating between the recording element board 10 and the channel member 210 by fluid connection. Accordingly, the support member 30 should have a high degree of flatness, and also should be able to be joined to the recording element board 10 with a high degree of reliability. Examples of suitable materials include alumina and resin materials. This support member 30 may be formed as a laminated configuration of a first support member where supply channels and recovery channels are formed, and a second support member where common supply channels and common recovery channels are formed. In this case, the rate of thermal spread of at least the first supper member is smaller than the rate of thermal spread of the recording element board 10.

As described above, the present embodiment enables backflow to the common recovery channel 212 to be prevented regardless of the driving state at the recording element boards 10, and further can suppress change in circulatory (supply) flow rate. Accordingly, a head configuration is provided where a circulatory flow that can ensure the advantages of circulation is maintained. Although a pressure adjustment mechanism is used in the present embodiment as a pressure generating source, the embodiments are not restricted to this. For example, a water head difference control configuration using a water level sensor may be used. This configuration is the same in the following embodiments as well.

Second Embodiment

Figure 9:
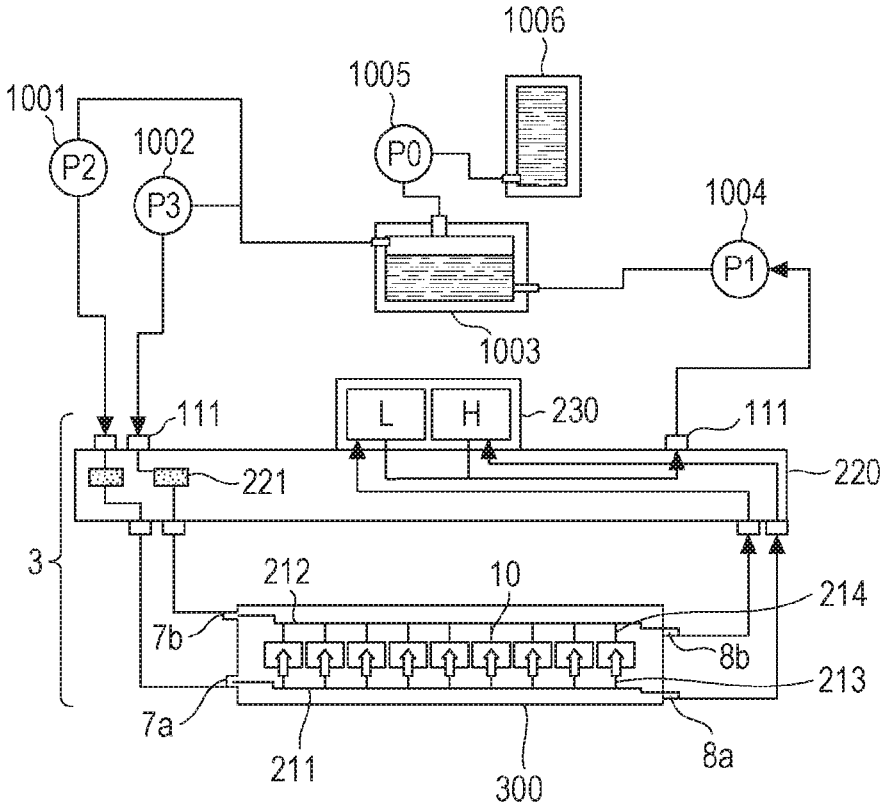
FIG. 9 is a diagram illustrating a channel configuration of a liquid discharge apparatus according to an exemplary embodiment.

FIG. 9 is a schematic diagram illustrating, of circulation paths applied to the recording apparatus according to the present embodiment, a second circulation path that is a different circulation path from the above-described first circulation path. The primary points of difference as to the above-described first circulation path are as follows. Both of the two pressure adjustment mechanisms making up the negative pressure control unit 230 have a mechanism (a mechanism part having operations equivalent to a so-called "backpressure regulator") to control pressure at the upstream side from the negative pressure control unit 230 to fluctuation within a constant range that is centered on a desired set pressure. The second circulation pump 1004 acts as a negative pressure source to depressurize the downstream side from the negative pressure control unit 230. The first circulation pump (high-pressure side) 1001 and first circulation pump (low-pressure side) 1002 are disposed on the upstream side of the liquid discharge head 3, and the negative pressure control unit 230 is disposed on the downstream side of the liquid discharge head 3.

The negative pressure control unit 230 according to the second embodiment stabilizes pressure fluctuation on the upstream side (i.e., at the liquid discharge unit 300 side) within a constant range that is entered in a predetermined pressure, even if the flow rate fluctuates due to change in duty when recording with the liquid discharge head 3. This enables the effects of water head pressure of the buffer tank 1003 as to the liquid discharge head 3 to be suppressed, giving a broader range of selection for the layout of the buffer tank 1003 in the recording apparatus 1000. Alternatively, a water head tank disposed with a certain water head difference as to the negative pressure control unit 230, for example, may be employed instead of the second circulation pump 1004. Integrating the pumps at the side of recovering ink from the liquid discharge head 3 into one in the present embodiment enables the number of pumps of the overall apparatus to be reduced, and the apparatus size to be reduced. The negative pressure control unit 230 illustrated in FIG. 3 also has two pressure adjustment mechanisms, with different control pressure from each other having been set, in the same way as the first embodiment. Of the two negative pressure adjustment mechanisms, the relatively high-pressure setting side (denoted by H in FIG. 9) and the relatively low-pressure setting side (denoted by L in FIG. 9) are respectively connected to the common supply channel 211 and the common recovery channel 212 within the liquid discharge unit 300 via the liquid supply unit 220. Also, the first inlet port 7*a* and first recovery port 8*a* are formed at the common supply channel 211, and the first inlet port 7*a* is connected to the first circulation pump (first liquid feed pump) 1001, and the first recovery port 8*a* to the pressure adjustment mechanism H, both in fluid connection. The second inlet port 7*b* and second recovery port 8*b* are formed at the common recovery channel 212, and the second inlet port 7*b* is connected to the first circulation pump (second liquid feed pump) 1002, and the second recovery port 8*b* to the pressure adjustment mechanism L, both in fluid connection.

The pressure of the common supply channel 211 is relatively controlled as to the pressure of the common recovery channel 212 by the two negative pressure adjustment mechanisms and two first circulation pumps. Accordingly, flows occur where ink flows from the common supply channel 211 through branch supply channels 213*a* and internal channels in the recording element boards 10 to the common recovery channel 212, and also, ink supplied from each inlet port becomes a flow that returns to the recovery port of the respective common channel without flowing through the recording element boards 10. The second circulation path thus yields an ink flow state the same as that of the first circulation path within the liquid discharge unit 300, but has two advantages that are different from the case of the first circulation path.

One advantage is that, with the second circulation path, the negative pressure control unit 230 is disposed on the downstream side of the liquid discharge head 3, so there is little danger that dust and foreign substances generated at the negative pressure control unit 230 will flow into the head. A second advantage is that the maximum value of the necessary flow rate supplied from the buffer tank 1003 to the liquid discharge head 3 can be smaller in the second circulation path as compared to the case of the first circulation path. The reason is as follows. The total flow rate within the common supply channel 211 and common recovery channel 212 when circulating ink during recording standby will be represented by A. The value of A is defined as the smallest flow rate necessary to maintain the temperature difference in the liquid discharge unit 300 within a desired range in a case where temperature adjustment of the liquid discharge head 3 is performed during recording standby. Also, the discharge flow rate in a case of discharging ink from all discharge orifices of the liquid discharge unit 300 (full discharge) is defined as F. Accordingly, in the case of the first circulation path (FIG. 2), the set flow rate of the first circulation pump (high-pressure side) 1001 and the first circulation pump (low-pressure side) 1002 is A, so the maximum value of the liquid supply amount to the liquid discharge head 3 necessary for full discharge is A+F.

On the other hand, in the case of the second circulation path (FIG. 9), the liquid supply amount to the liquid discharge head 3 necessary at the time of recording standby is flow rate A. This means that the supply amount to the liquid discharge head 3 that is necessary for full discharge is flow rate F. Accordingly, in the case of the second circulation path, the total value of the set flow rate of the first circulation pump (high-pressure side) 1001 and the first circulation pump (low-pressure side) 1002, i.e., the maximum value of the necessary flow rate, is the larger value of A and F. Thus, the maximum value of the necessary supply amount in the second circulation path (A or F) is always smaller than the maximum value of the necessary flow rate in the first circulation path (A+F), as long as the liquid discharge unit 300 of the same configuration is used. Consequently, the degree of freedom regarding circulatory pumps that can be employed is higher in the case of the second circulation path, which is advantageous in that, for example, low-cost circulatory pumps having simple structure can be used, the load on a cooler (omitted from illustration) disposed on the main unit side path can be reduced, thereby reducing costs of the recording apparatus main unit. This advantage is more pronounced with line heads where the values of A or F are relatively great, and is more useful the longer the length of the line head is in the longitudinal direction.

However, there are points where the first circulation path is more advantageous than the second circulation path. That is to say, with the second circulation path, the flow rate flowing through the liquid discharge unit 300 at the time of recording standby is maximum, so the lower the recording duty of the image is, the greater a negative pressure is applied near the discharge orifices. Accordingly, in a case where the channel widths of the common supply channel 211 and common recovery channel 212 (the length in a direction orthogonal to the direction of flow of liquid) is reduced to reduce the head width (the length of the liquid discharge head in the transverse direction), high negative pressure is applied near the discharge orifices in low-duty images where unevenness is conspicuous. This may result in more influence of satellite droplets. On the other hand, high negative pressure is applied near the discharge orifices when forming high-duty images in the case of the first circulation path, so any generated satellites are less conspicuous, which is advantageous in that influence on the image quality is small. Which of these two circulation paths is more preferable can be selected in light of the specifications of the liquid discharge head and recording apparatus main unit (discharge flow rate F, smallest circulatory flow rate A, channel resistance within the head, etc.).

As described above, the present embodiment enables backflow to the common recovery channel 212 to be prevented regardless of the driving state at the recording element boards 10, in the same was as the first embodiment, and further can suppress the range of fluctuation in circulatory (supply) flow rate. Accordingly, a head configuration is provided where a circulatory flow that can ensure the advantages of circulation is maintained.

Rate of Thermal Spread at Channel Member

Figure 10:
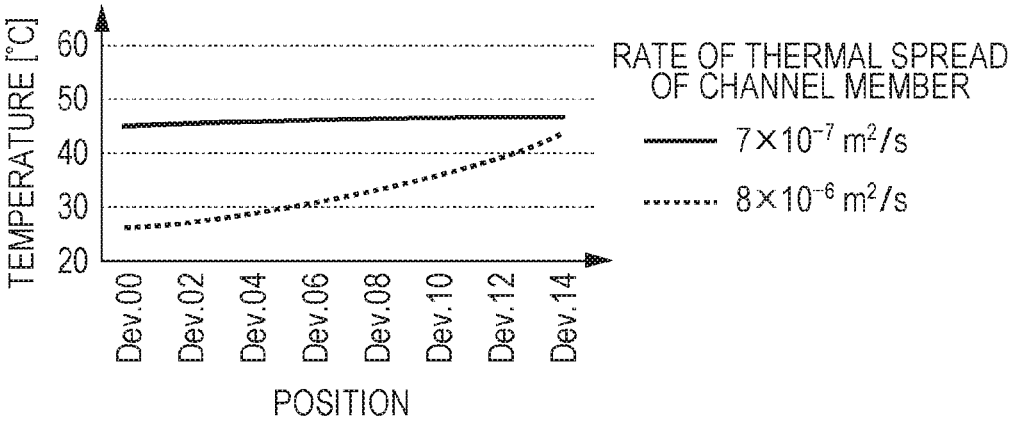
FIG. 10 is a diagram illustrating temperature distribution of recording elements when driving the liquid discharge head according to an exemplary embodiment.

FIG. 10 is a diagram illustrating temperature distribution at the recording element boards 10, suitable for describing features of the liquid discharge head 3 according to the embodiments. The horizontal axis represents the direction in which the common channels extend, and the vertical axis represents the temperature of the recording element boards 10. The rate of thermal spread in the channel member 210 according to the present embodiment is smaller than the rate of thermal spread of the recording element board 10, with the solid line representing a head where the rate of thermal spread of the channel member 210 is $7\times10^{-7}$ $m^2/s$. FIG. 10 illustrates in dotted lines a head where the rate of thermal spread of the channel member 210 is $8\times10^{-6}$ $m^2/s$, for comparison with the effects of the present embodiment. It can be seen from FIG. 10 that in a case where the rate of thermal spread of the channel member 210 becomes higher than the rate of thermal spread of the recording element board 10, temperature difference occurs from the inlet port communicating with the common channel toward the recovery port. On the other hand, in a case where the rate of thermal spread is low, the temperature is maintained generally constant regardless of the position on the recording element board 10. Thus, in a configuration where multiple recording element boards 10 are arrayed in the direction in which the common channels extend, and ink flows through the common channels, heat is transmitted from the recording element boards 10 less readily, thereby enabling variation in the volume of discharged ink droplets to be suppressed. Although description has been made here by way of a specific numerical value for the rate of thermal spread of the channel member, this configuration is not restrictive, as long as a function is added that the heat from the recording element board 10 is not readily transmitted to the ink in the common channels.

Third Embodiment

Figure 11:
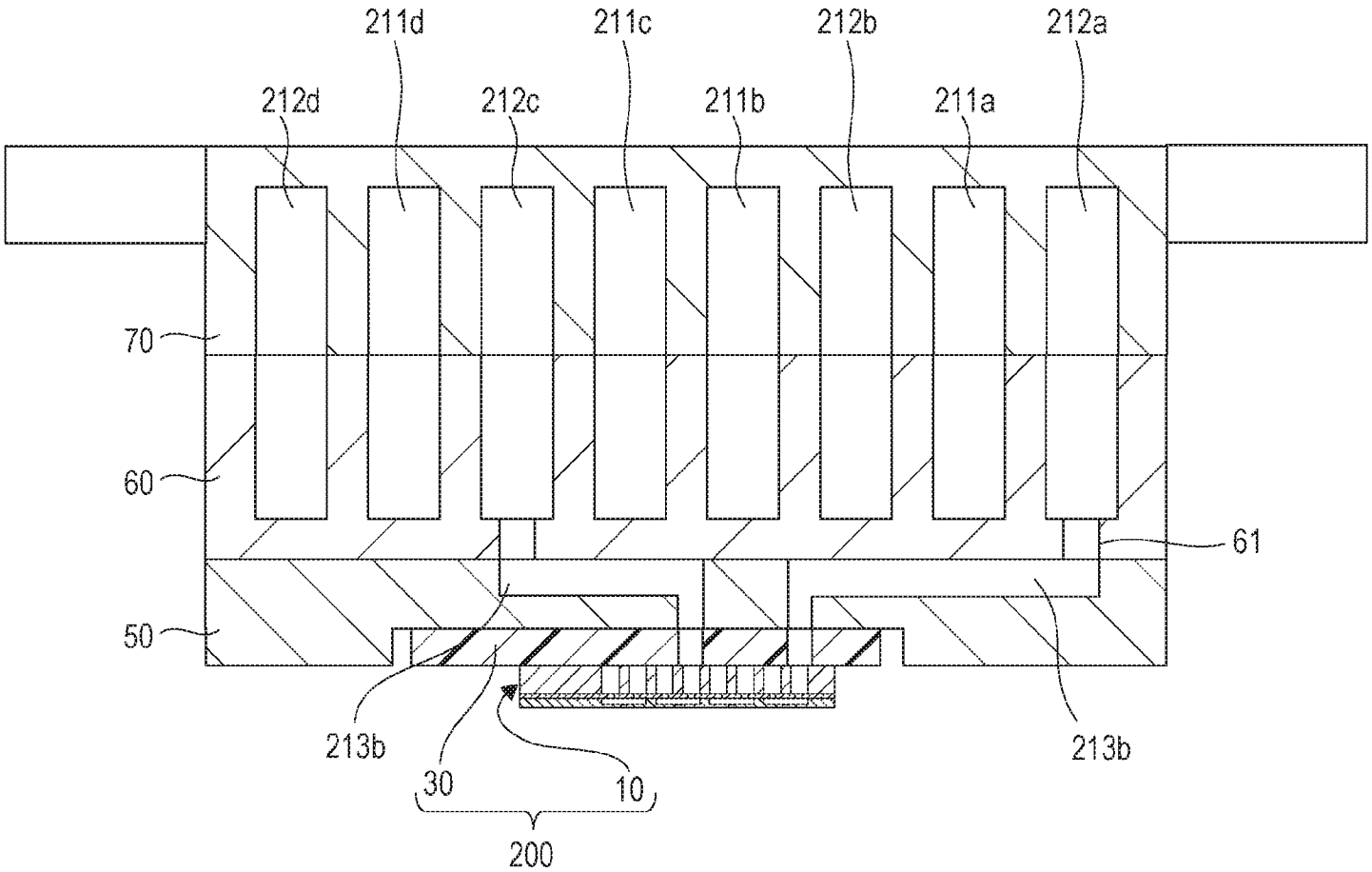
FIG. 11 is a cross-sectional view of a liquid discharge head according to a third embodiment.

A third embodiment will be described with reference to FIG. 11. An ink flow state is obtained in the present embodiment, in the same way as with the first embodiment or the second embodiment. Portions that are the same as in the above-described embodiments will be denoted by the same reference numerals, and description will be omitted. FIG. 11 is a diagram illustrating a cross-section of a liquid discharge head 3 of the present embodiment, with multiple layers of channel members having been formed. At a second channel member 60 and a third channel member 70, common channels (211*a* through 211*d* and 212*a* through 212*d*) are formed extending in the direction in which the recording element boards 10 are arrayed (longitudinal direction of the channel members). Multiple branch channels 213*d* (individual channels) are formed on a first channel member 50, extending in a direction orthogonal to the common channels (transverse direction) of the channel member. Forming the branch channel grooves and common channel grooves on different members enables members, where long grooves and intersecting extremely fine grooves coexist, to be formed by molding resin, for example, which is advantageous in that manufacturing costs can be reduced.

Although the present embodiment describes three layers of channel members 50, 60, and 70, there is no particular restriction on the number of layers, as long as the idea that the common channels and the branch channels are configured using separate members is realized. One channel member forming the branch channels may be formed for each recording element board 10, or one maybe formed for multiple recording element boards 10, or one may be formed for all recording element boards 10. In any case, the configuration thereof is not restricted as long as forming the common channels and branch channels on separate members is realized.

Fourth Embodiment

Figure 12:
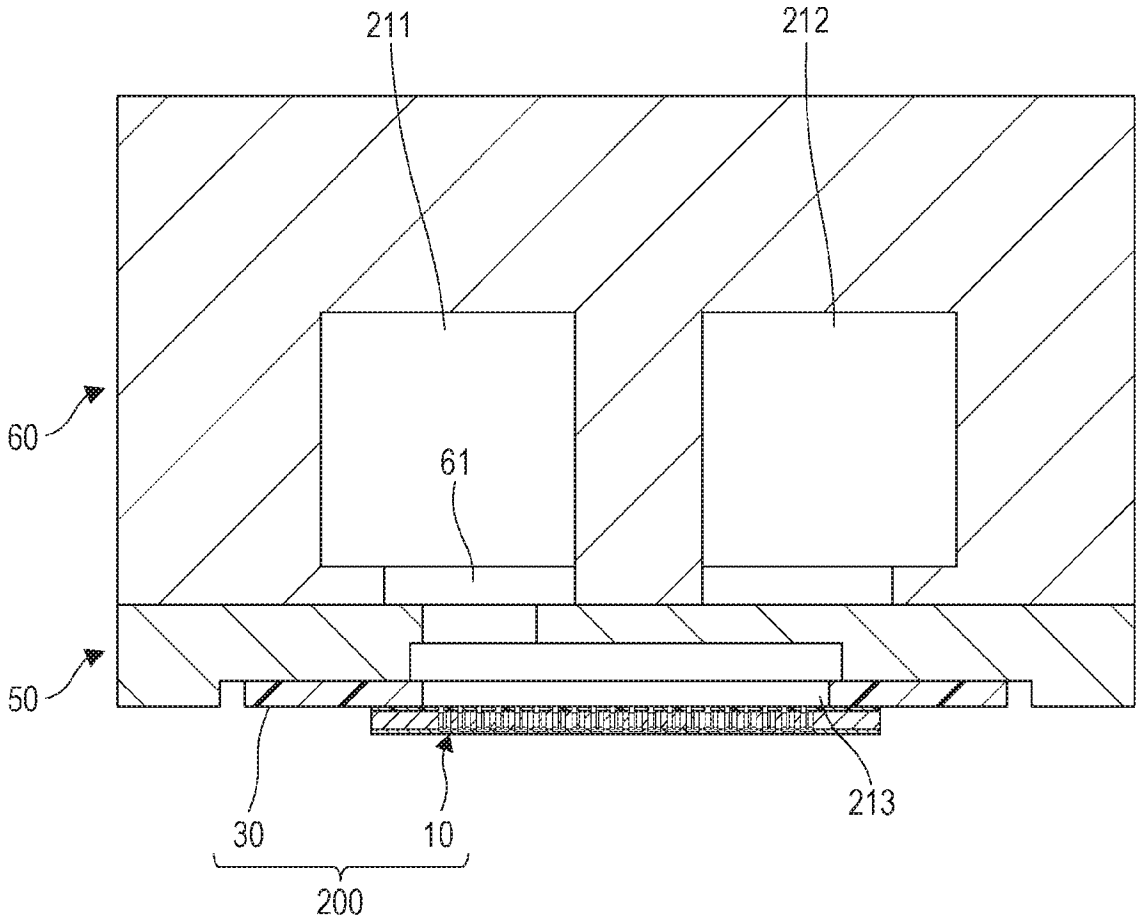
FIG. 12 is a cross-sectional view of a liquid discharge head according to a fourth embodiment.

The connection relationship of common channels, branch channels, and multiple pressure chambers in a fourth embodiment is the same as in the embodiments described above, with a flow of ink that does not go through the pressure chambers but just passes through the common channels, and a flow of ink that passes from the common supply channel through the pressure chambers and to the common recovery channel, being obtained. FIG. 12 is a diagram illustrating a cross-section of the liquid discharge head 3 according to the present embodiment. The channel members making up the liquid discharge head 3 according to the present embodiment is a multi-layer structure in the same way as in the third embodiment. The slender channel members making up the common channels are formed of a material having approximately the same linear expansion coefficient as the recording element boards 10, in order to maintain the mounting precision of the recording element boards 10 to a high level of precision. Specific examples of assumed materials for the second channel member 60 include inorganic materials such as silicon and alumina or the like, metal materials having a lower linear expansion coefficient such as inver or the like, with the rate of thermal spreading being values close to that of the recording element board 10 in each case. In the present embodiment, the rate of thermal spreading of the first channel member 50 forming the multiple branch circuits is set lower than that of the recording element board 10 or second channel member 60. This makes it more difficult to transmit heat from the recording element boards 10 to the ink passing through the common channels, thereby enabling the volume of the discharge ink droplets to be made uniform.

Although the present embodiment describes two layers of channel members 50 and 60, there is no particular restriction on the number of layers, as long as the idea that the common channels and the branch channels are configured using separate members is realized. Although only one color worth of common channels are illustrated in the drawings, multiple colors worth of common channels may be formed, as long as the configuration is such that the first channel member 50 does not readily transmit heat between the recording element boards 10 and the second channel member 60, and the second channel member 60 is not deformed due to disturbances such as heat, swelling, and so forth.

Configuration of Recording Element Board

Figure 13A:
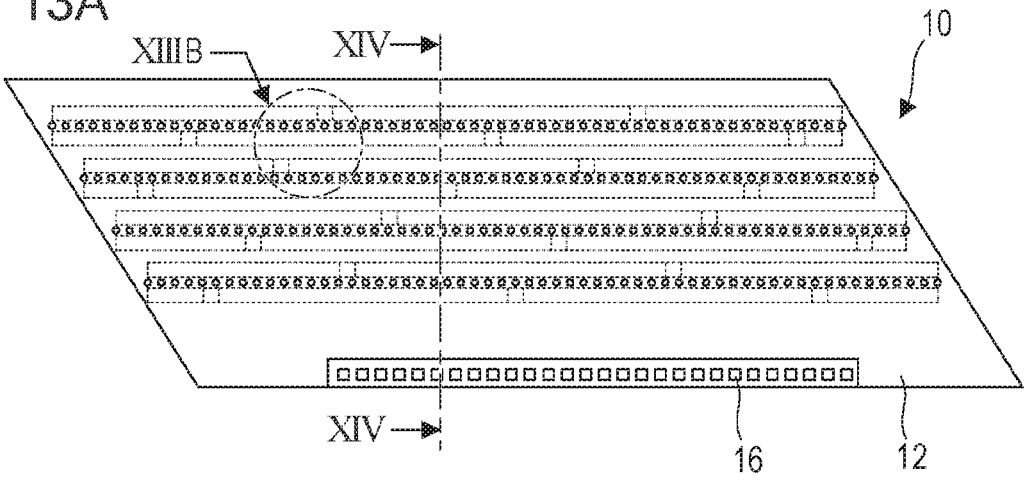
FIGS. 13A through 13C are transparent drawings of a recording element board according to an embodiment.
Figure 13B:
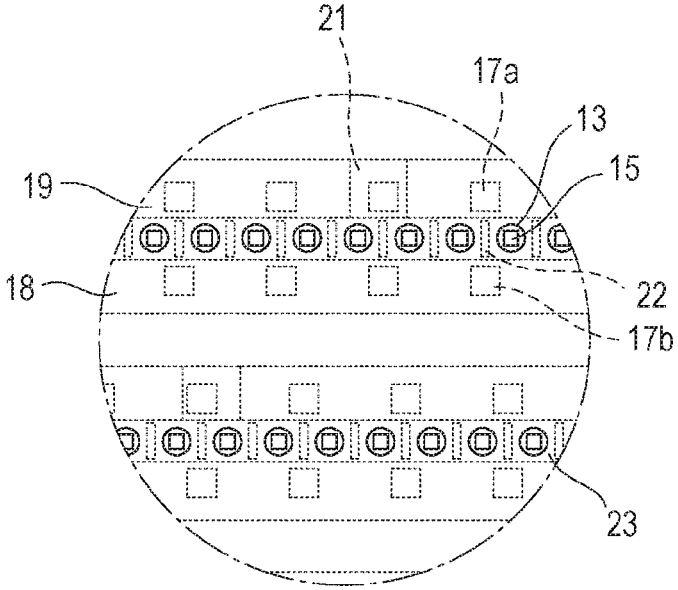
Figure 13C:
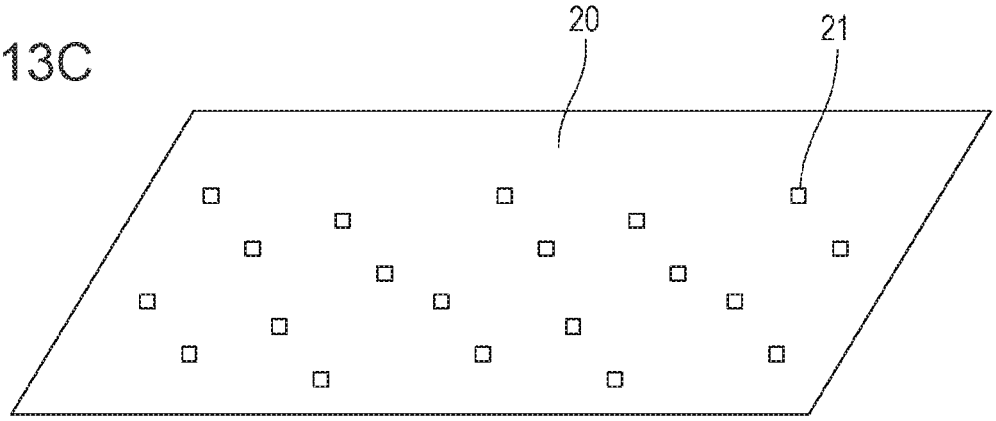
Figure 14:
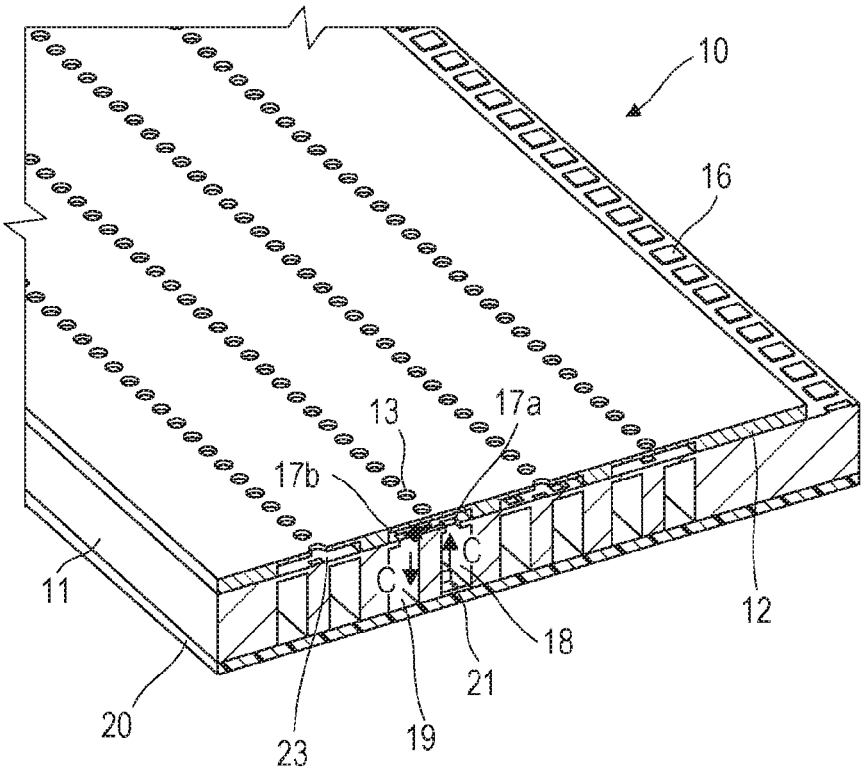
FIG. 14 is a partial cutaway perspective view of the recording element board according to an exemplary embodiment.

The configuration of a recording element board applicable to the embodiments will be described with reference to FIGS. 13A through 13C. The recording element board 10 has a discharge orifice forming member 12, where four discharge orifice rows corresponding to the ink colors are formed, as illustrated in FIG. 13A. Note that hereinafter, the direction in which the discharge orifice rows, where multiple discharge orifices 13 are arrayed, extend, will be referred to as "discharge orifice row direction". A liquid supply channel 18 extends along one side of each discharge orifice row, and a liquid recovery channel 19 along the other, as illustrated in FIG. 13B. The liquid supply channels 18 and liquid recovery channels 19 are channels extending in the direction of the discharge orifice rows provided on the recording element board 10, and communicate with the discharge orifices 13 via supply ports 17*a* and recovery ports 17*b*, respectively. A sheet-shaped cover plate 20 is laminated on the rear face from the face of the recording element board 10 on which the discharge orifices 13 are formed, the cover plate 20 having multiple openings 21 communicating with the liquid supply channel 18 and liquid recovery channel 19 which will be described later, as illustrated in FIGS. 13C and 14. In the present embodiment, three openings 21 are provided in the cover plate 20 for each liquid supply channel 18, and two openings 21 are provided for each liquid recovery channel 19. The openings 21 of the cover plate 20 communicate with the multiple communication ports 51, as illustrated in FIG. 13B. The cover plate 20 functions as a lid that makes up part of the sides of the liquid supply channel 18 and liquid recovery channel 19 formed in the substrate 11 of the recording element board 10, as illustrated in FIG. 14 that is a cross-sectional view taken along line XIV-XIV in FIG. 13A. The cover plate 20 preferably is sufficiently corrosion-resistant as to the liquid, and has to have a high degree of precision regarding the opening shapes of the openings 21 and the positions thereof from the perspective of color mixture prevention. Accordingly, a photosensitive resin material or silicon is used as the material for the cover 20, with the openings 21 preferably being formed by photolithography process. The cover plate 20 thus is for converting the pitch of channels by the openings 21. The cover plate 20 preferably is thin, taking into consideration pressure drop, and preferably is formed of a film material.

Next, the flow of ink within the recording element board 10 will be described. The liquid supply channel 18 and liquid recovery channel 19 made up of the substrate 11 and cover plate 20 are respectively connected to the common supply channel 211 via the branch supply channel 213*a*, and the common recovery channel 212 via the branch recovery channel 213*b*. Accordingly, there is differential pressure between the liquid supply channel 18 and liquid recovery channel 19 due to the two negative pressure adjustment mechanisms, and the ink flows from the liquid supply channel 18 to the liquid recovery channel 19 via the supply port 17*a*, the pressure chamber 23, and the recovery port 17*b* (the flow indicated by the arrows C in FIG. 14).

Next, the flow of ink within the liquid discharge head 3 will be described. The first inlet port 7*a* and the first recovery port 8*a* communicate with the common supply channel 211 in fluid connection and the second inlet port 7*b* and the second recovery port 8*b* communicate with the common recovery channel 212. This configuration satisfies the same two Inequalities as in the first embodiment, so the flow of ink within the liquid discharge head 3 is largely made up of the following three paths. The first is a flow from the first inlet port 7*a* through the common supply channel 211 and to the first recovery port 8*a*. The second is a flow from the second inlet port 7*b* through the common recovery channel 212 to the second recovery port 8*b*. The third is a flow from the first inlet port 7*a*, through the common supply channel 211, branch supply channel 213*a*, liquid supply channel 18, pressure chamber 23, liquid recovery channel 19, branch recovery channel 213*b*, and common recovery channel 212 to the second recovery port 8*b*. The thickened ink generated by evaporation from the discharge orifices 13, bubbles, foreign substance, and so forth, can be recovered into the liquid recovery channel 19 by these flows from the discharge orifices 13 and pressure chamber 23 where recording is stopped. Thickening of ink at the discharge orifices 13 and pressure chamber 23 can also be suppressed. Thus, providing a path of flow without going through the recording element board 10 enables backflow of circulatory flow of the liquid to be suppressed even in a case where the recording element board 10 has fine channels where the flow resistance is great, as in the case of the present embodiment. Accordingly, the liquid discharge head 3 according to the present embodiment can suppress thickening of liquid in the pressure chambers 23 and near the discharge orifices 13, and thereby can suppress deviation in discharge direction and defective discharge, and consequently can record with high quality.

Amount of Ink Supplied to Liquid Discharge Head

In the present embodiment, the total amount of ink supplied to the inlet ports of the common supply channel 211 and common recovery channel 212 is greater than the total sum of the ink amount discharged from all recording element boards 10 disposed on the channel members. Accordingly, the flow through each common channel is a one-way flow from the inlet port to the recovery port regardless of discharge operations, so there is no backflow of ink, of which the volatile component of ink has evaporated, into the head at the time of passing through the discharge orifices 13. Even if ink that has been heated by the heating unit, to maintain the amount of ink being discharged at a constant level, flows through the liquid recovery channel 19, branch recovery channel 213*b*, and common recovery channel 212, temperature rise of ink within the common recovery channel 212 can be suppressed.

Regarding Temperature Adjustment of Ink

Configurations and advantages of the present embodiment will be described by way of specific relational expressions. In a case where the rate of thermal spread of the first channel member 50 is relatively small, and the system is such that the heat generated at the recording element board 10 is not readily transmitted to ink within the channel members, the respective relationships when in thermal equilibrium satisfy the following expressions $$T_{outflow_out}=(Q_{outflow}\times T_{ini}+Q_{branch}\times T_{outflow_branch})/(Q_{outflow}+Q_{branch}) \quad \text{Expression (1)}$$

$$T_{ini}<T_{outflow_branch} \quad \text{Expression (2)}$$

where $T_{ini}$ represents the ink temperature at the second inlet port 7*b*, $T_{outflow_branch}$ represents the ink temperature at the branch recovery channel 213*b*, $T_{outflow_out}$ represents the ink flow rate flowing into the common recovery channel 212 from the second inlet port 7*b*, $Q_{branch}$ represents the ink temperature at the communication ports 61 which communicates with the common recovery channel 212, and $Q_{outflow}$ represents the total amount of ink flowing through the pressure chambers 23 and into the branch recovery channel 213*b*.

Increase in temperature of the ink within the common recovery channel 212 can be suppressed by controlling the ink flow rate supplied to the second inlet port 7*b* of the liquid discharge head 3 from the buffer tank 1003 to be greater than the amount supplied to the first inlet port 7*a*, based on the above Expressions (1) and (2). Even if ink that has been heated by the heating unit at the time of passing through the discharge orifices 13 flows through the liquid recovery channel 19, branch recovery channel 213*b*, and common recovery channel 212, increase in temperature can be suppressed by the ink flowing through the common recovery channel 212, and consequently high-quality recording can be performed.

The present embodiment will be described using specific numerical values. In order for ink to flow at a flow velocity of 30 mm/s through a pressure chamber 23 that is 30 μm wide and 15 μm high, if the flow resistance of the branch channels and common channels is smaller than the pressure chamber 23 to the point of being practically negligible, this can be realized by setting the pressure difference between the two pressure adjustment mechanisms to around 1400 Pa.

If the discharge amount is $5\times10^{-15}$ $m^3$, the discharge amount from the discharge orifices 13 is less than the amount of supply by pressure difference in a case where the drive frequency is lower than 2.7 kHz, so on a macro timescale, the ink flow passes through the supply port 17*a* and reaches the recovery port 17*b* even when discharging. In a case where discharge operations are not being performed, the ink within the pressure chambers 23 is being heated to within a set temperature range, so the temperature of ink near the liquid supply channel 18 and liquid recovery channel 19 is somewhat high. However, when performing discharging operations, ink of approximately the same amount of ink being discharged flows in, so the ink temperature around the pressure chambers 23 is lower than when not driving. That is to say, even though the flow of ink from the supply port 17*a* and to the recovery port 17*b* is the same on a macro timescale, the way that heat is transmitted differs depending on whether non-driving or driving, the temperature of ink in the pressure chambers 23 changes transiently, inducing variance in discharge properties. This variance in discharge properties causes deterioration in image quality, but the deterioration in image quality is more readily visibly perceived when the ink does not fill in the recording medium solid in particular. That is to say, the effects of variance in discharge properties are greater when the drive frequency is not very high.

In order to suppress this phenomenon, the present embodiment has a configuration where the flow rate is increased by increasing the flow rate just at the first circulation pump (high-pressure side) 1001 connected to the common supply channel 211. The total discharge amount $Q_{inje}$ is expressed by $$Q_{inje}=Q_{in}-Q_{out}$$

where $Q_{in}$ represents the flow rate flowing into the ink supply port 17*a* via the common supply channel 211 when performing discharging operations, $Q_{out}$ represents the flow rate of ink being discharged to the common recovery channel 212 via the recovery port 17*b*, and $Q_{inje}$ represents the total amount of discharge due to driving.

Further, the ink temperature $T_{inje}$ within individual liquid chambers at the time of discharging is expressed as $$T_{inje}\propto(S_{heater}+T_{in\text{-}ch}(t)\times Q_{in}-T_{out\text{-}ch}(t)\times Q_{out})/Q_{inje}$$

where $S_{heater}$ represents the amount of heat generated by the heater due to discharging operations, in which $$T_{in\text{-}ch}(t)\leq T_{out\text{-}ch}(t)$$

where time function $T_{in\text{-}ch}(t)$ represents the ink temperature at the branch supply channel 213*a* and the liquid supply channel 18 and time function $T_{out\text{-}ch}(t)$ represents the ink temperature at the branch recovery channel 213*b* and liquid recovery channel 19.

It can be seen that by increasing the amount of ink supplied from the buffer tank 1003 in accordance with the above equation, proportional expression, and inequality, transient rise in ink temperature can be suppressed by lowering the temperature of ink flowing in from the supply port 17*a*. However, there is a disadvantage in increasing the supply amount of ink, in that the pressure drop is great in the pressure chambers 23 and channels communicating therewith. Accordingly, lowering the temperature of ink flowing in from the supply port 17*a* is effective in suppressing transient ink temperature. Further, only the flow rate of the first circulation pump (high-pressure side) 1001 is changed, so increased power consumption of the overall apparatus can be minimized.

As described above, increase in ink temperature at the inlet side due to heat from temperature control being propagated is suppressed by increasing the flow rate at the common supply channel 211 in the present embodiment. Accordingly, rise in ink temperature due to change in the driving state can be reduced.

Fifth Embodiment

Figure 15:
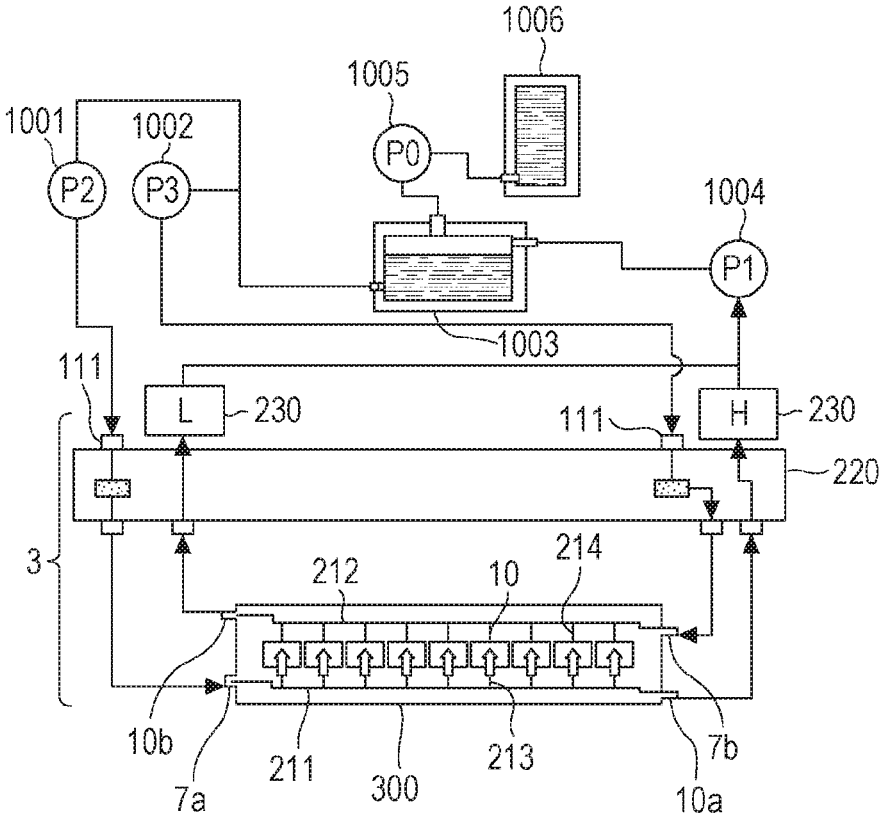
FIG. 15 is a diagram illustrating a channel configuration of a liquid discharge apparatus according to a fifth embodiment.
Figure 16A:
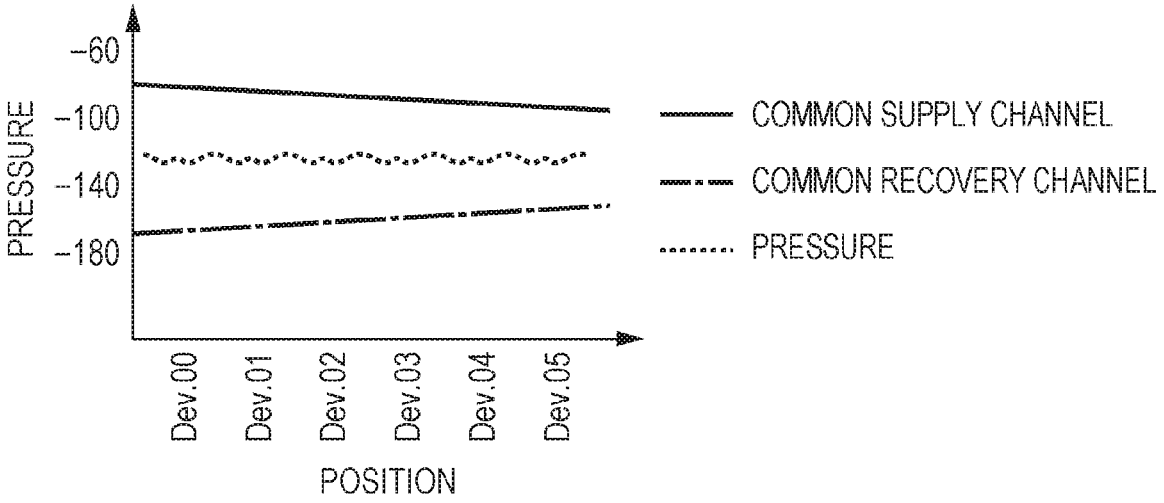
FIGS. 16A and 16B are diagrams illustrating pressure distribution at each pressure chamber of the liquid discharge head according to the fifth embodiment, where the flow directions of common channels are opposite directions in FIG. 16A, and the flow directions of common channels are the same direction in FIG. 16B.

A fifth embodiment will be described with reference to FIG. 15. The direction of flow of ink is opposite between the common supply channel 211 and common recovery channel 212 in the present embodiment, as illustrated in FIG. 15. FIG. 16A illustrates the distribution of negative pressure applied to the pressure chambers 23 in the direction in which the common channels extend. The solid line indicates the pressure distribution within the common supply channel 211, the single-dot dashed line illustrates the pressure distribution in the common recovery channel 212, and the dotted line represents the pressure distribution within the pressure chambers 23. The direction of flow of the common supply channel 211 is a direction from the left side to the right side in FIG. 15, and the direction of flow of the common recovery channel 212 is a direction from the right side to the left side in FIG. 15. The pressure value within the pressure chambers 23 is a generally uniform state, which can be seen from FIG. 16A. In a case where the size of the discharge orifices 13 is large, for example, the amount of ink discharged from the discharge orifices 13 will change sensitively to the static pressure value applied to the pressure chambers 23. However, the configuration according to the present embodiment enables uniform ink to be discharged from every pressure chamber 23 in the liquid discharge head 3, so high-quality printing can be obtained. Also, the negative pressure control unit 230 can be divided as illustrated in FIG. 15, so the dimensions can be reduced, and separate units can be disposed at different positions. This markedly improves the degree of freedom of placement of the negative pressure control unit 230 within the liquid discharge head 3, and realizes a form that is easy for the user to handle. Also, the pumps communicating with the negative pressure control unit 230 have been integrated into one in the present embodiment as well, so the number of pumps in the overall apparatus can be reduced, and the size of the apparatus can be reduced.

Figure 16B:
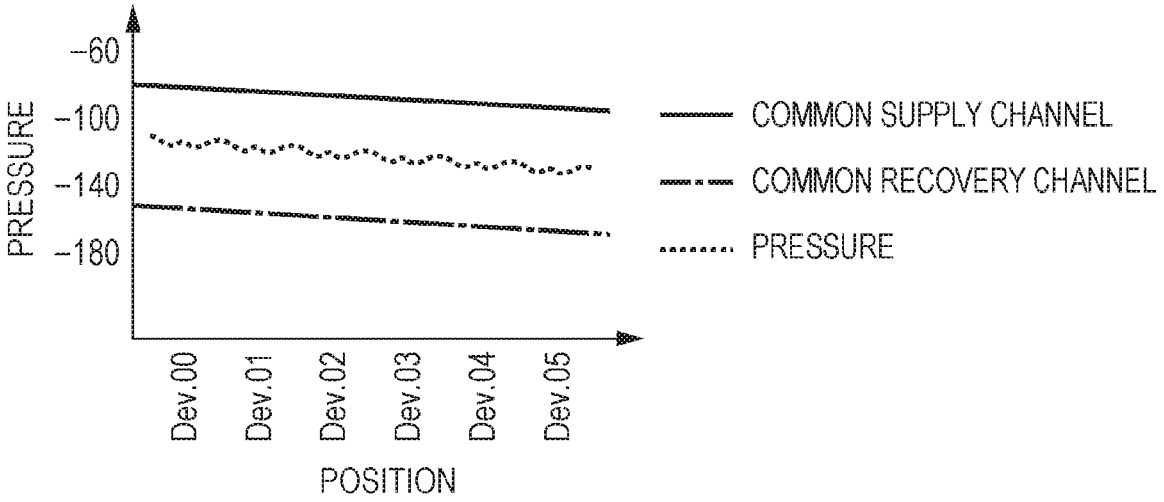

On the other hand, FIG. 16B illustrates the distribution of negative pressure applied to the pressure chambers 23 in the direction in which the common channels extend in a case where the flow direction of ink in the common supply channel 211 and common recovery channel 212 is the same direction, as in the above-described embodiments. The direction of flow in the common channels is the direction from the left side in FIG. 15 toward the right. In this case, the pressure value in the pressure chambers 23 falls along the direction of flow, but the pressure difference between the common supply channel 211 and common recovery channel 212 is maintained almost the same. In a case where the ink is of a composition where the physical properties of ink change within the pressure chambers 23 due to evaporation of volatile medium within the ink from the discharge orifices 13 for example, there is need to suppress change in the physical properties by moving the ink from the supply port 17*a* through the pressure chamber 23 to the recovery port 17*b*. In this case, change in physical properties of the ink can be suppressed at every pressure chamber 23 within the liquid discharge head 3 by the flow direction of the common supply channel 211 and common recovery channel 212 being the same, whereby desired discharge properties can be obtained, and as a result printing with a high level of reliability can be realized. In a case of forming multiple common supply channels 211 and common recovery channels 212 within the channel member 210, the channel cross-sectional area of the common channels needs to be large in order to suppress pressure drop within the common channels to a certain level. However, the results on the short side direction of the channel member being longer. Generally, liquid discharge apparatuses have a mechanism that mechanically presses the recording medium, to maintain the spacing between the recording medium and the liquid discharge head 3 to a certain value. However, the farther away in the conveyance direction from the position where the recording medium is being pressed, the harder it is to maintain the gap between the liquid discharge head 3 and the recording medium constant. Accordingly, the dimension of the liquid discharge head 3 in the short side direction (the length of the conveyance direction of the recording medium) is preferably as small as possible, and there are cases where the direction of flow of the common channels is the same. Accordingly, highly reliable and high-quality printing can be realized by setting the flow direction of the common channels to be opposite if opposite is more preferable in accordance with the specifications of the liquid discharge head 3, and set being the same direction if the same direction is preferable.

Sixth Embodiment

In a sixth embodiment, the common supply channel 211 and common recovery channel 212 have resistance portions 217*a* and 217*b* formed, where the flow resistance is locally larger than other channels. Specifically, the resistance of the resistance portion 217*b* is larger than the upstream portion of the common supply channel 211, and the resistance of the resistance portion 217*a* is larger than the downstream portion of the common recovery channel 212. The resistance portion 217*a* is formed between the recovery port 8 and the branch supply channel 213*a* closest to this recovery port 8. The resistance portion 217*b* is formed between the inlet port 7 and the branch recovery channel 213*b* closest to this inlet port 7.

Figure 17:
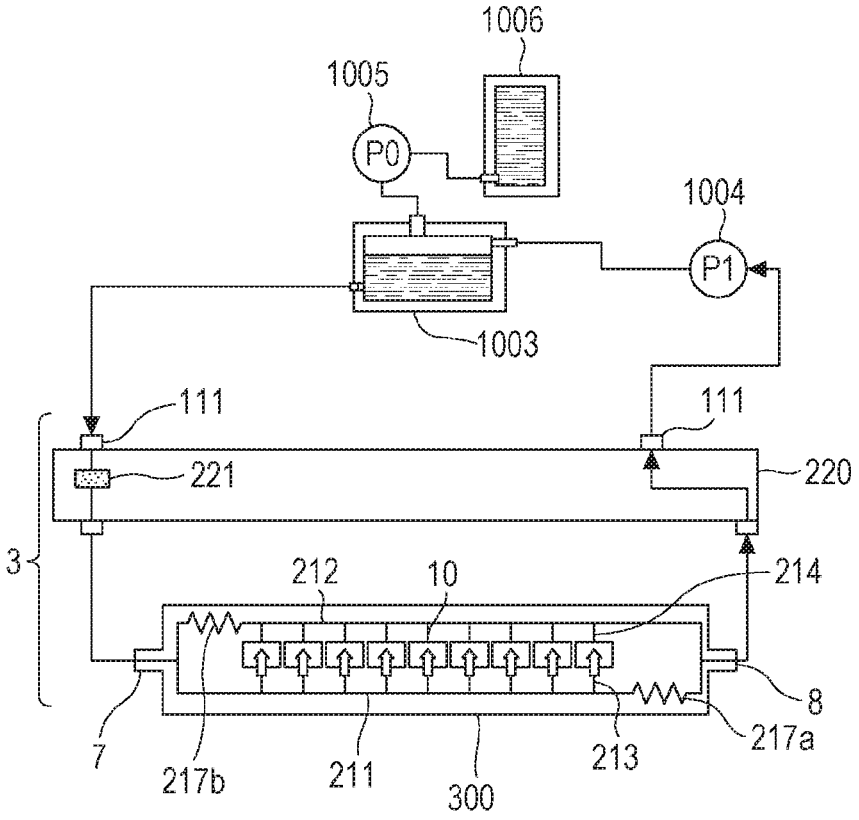
FIG. 17 is a diagram illustrating a channel configuration of a liquid discharge apparatus according to a sixth embodiment.
Figure 18:
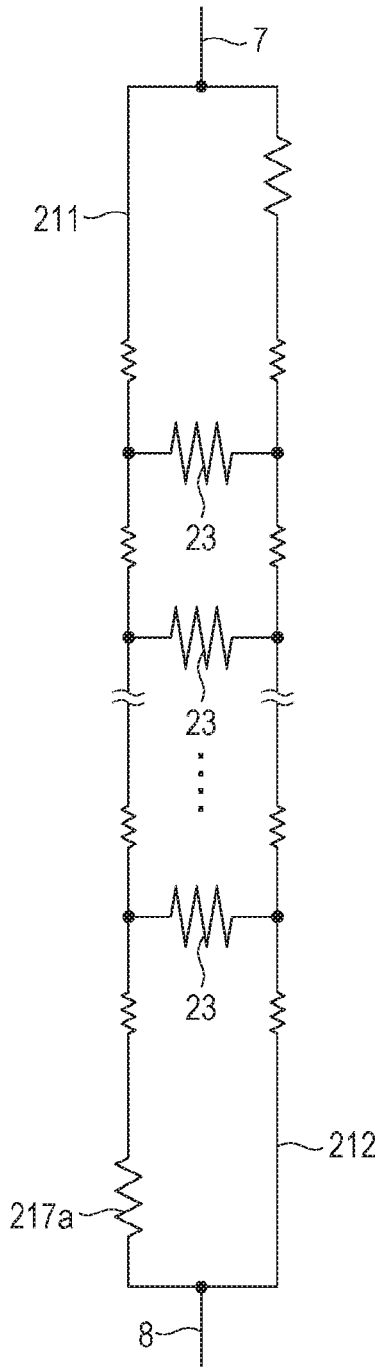
FIG. 18 is an equivalent circuit diagram of internal channels of the liquid discharge head according to the sixth embodiment.

FIG. 17 illustrates the overall configuration of the liquid discharge apparatus according to the present embodiment, and FIG. 18 is an equivalent circuit diagram of internal channels of the liquid discharge head 3. The inlet port 7 is connected to the buffer tank 1003, and the recovery port 8 is connected to the second circulation pump 1004. This configuration generates differential pressure between the common supply channel 211 and common recovery channel 212 that is equivalent to the amount of pressure drop at the resistance portions 217*a* and 217*b*. Accordingly, a flow can be formed that passes through the pressure chambers 23 regardless of the driving state of each recording element board 10, and a flow that flows from the inlet port 7 to the recovery port 8 without going through the pressure chambers 23. The inlet port 7 and recovery port 8 of the liquid discharge unit 300 have been integrated into one each, so the number of joint portions for liquid communication as to the liquid discharge head 3 can be reduced. Providing the resistance portions 217*a* and 217*b* also enables the number of pumps in the overall apparatus to be markedly reduced, and downsizing of the apparatus can be realized. Liquid inlets and outlets being provided for the common supply channel 211 and common recovery channel 212 enable liquid to be supplied to the liquid discharge head 3 by circulation while suppressing increased pressure drop with the present embodiment as well, in the same way as in the above-described embodiments.

In the same way as the embodiments described above, the total flow rate per unit time of liquid flowing through the common supply channel 211 and common recovery channel 212 is greater than the total amount of liquid discharged per time unit from all discharge orifices 13 communicating with the common supply channel 211. Accordingly, even if all discharge orifices 13 communicating with the common supply channel 211 are driven, the direction of flow of the common supply channel 211 and common recovery channel 212 does not change.

Differential pressure is generated within the liquid discharge head 3 in the present embodiment, so the circulation flow flowing through the discharge orifices 13 can be generated without making a complex configuration of the apparatus main unit. Although no unit that provides the flow resistance has been clearly specified in the present embodiment, any arrangement, such as reducing the channel cross-section area or making the wall faces coarser or the like, may be used as long as channel resistance is applied, and there is no particular restriction regarding the configuration thereof.

The channel configuration according to the present embodiment includes a first circulation pump (high-pressure side) and first circulation pump (low-pressure side) in fluid connection with first and second inlet ports, and a second circulation pump (high-pressure side) and second circulation pump (low-pressure side) connected in fluid connection with first and second recovery ports. The configuration of the present embodiment is capable of more precise control of pressure or flow rate at the common supply channel 211 and common recovery channel 212, in comparison with the above-described embodiments. As a result, stable discharge properties can be realized regardless of operation state, and higher quality images can be output.

Seventh Embodiment

The inkjet recording apparatus 1000 and liquid discharge head 3 according to a seventh embodiment will be described. The following description primarily will be made regarding points of difference as to the first through sixth embodiments, and portions that are the same as the first embodiment will be omitted from description.

Description of Inkjet Recording Apparatus

Figure 25A:
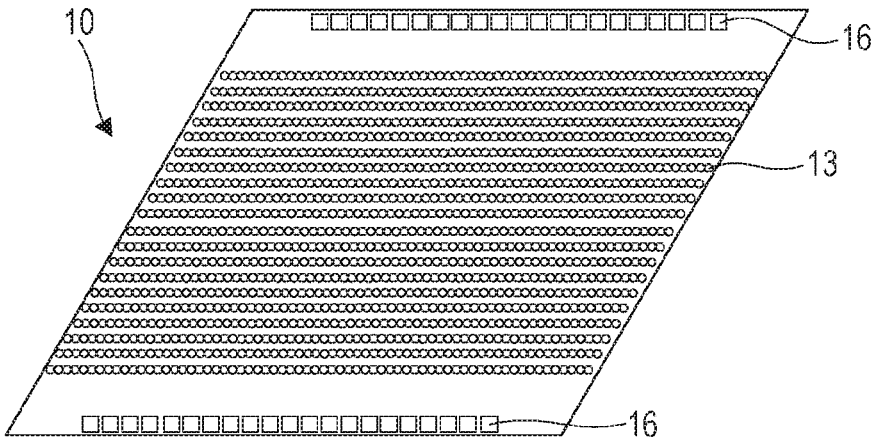
FIGS. 25A through 25C are diagrams of the recording element board of the liquid discharge head in FIG. 20, FIG. 25A being a plane view, FIG. 25B illustrating an intermediate portion, and FIG. 25C a bottom view.
Figure 26:
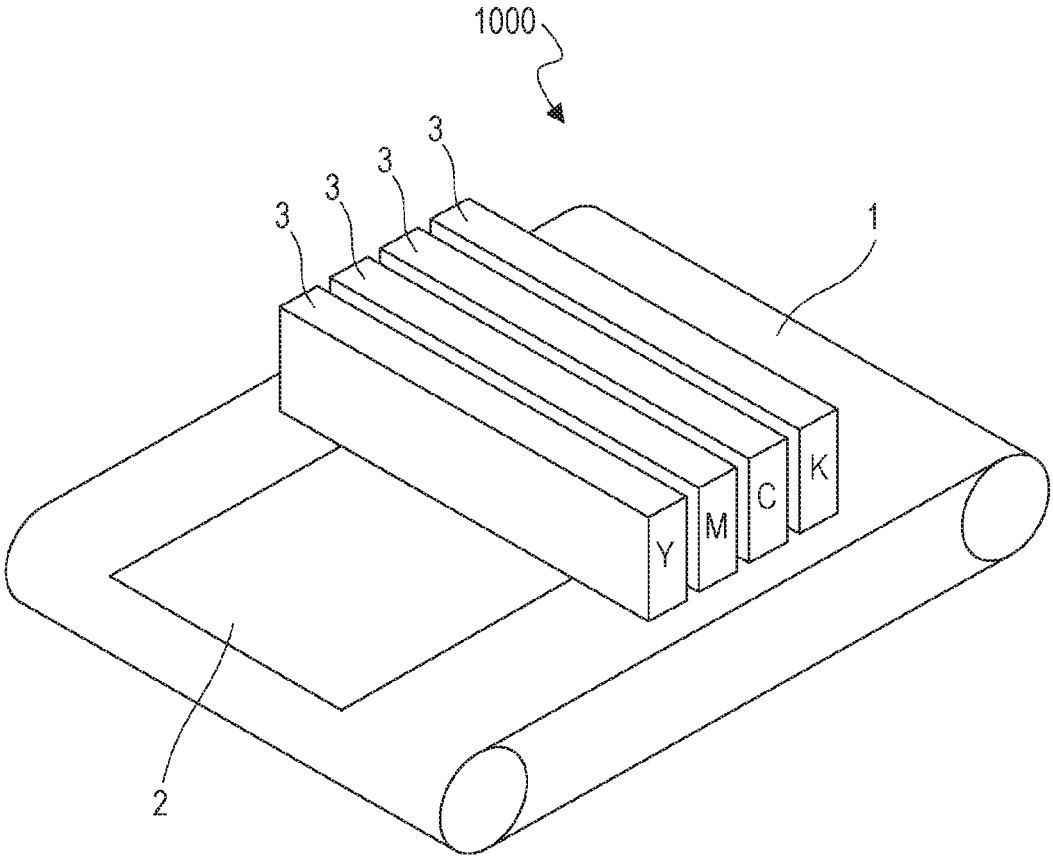
FIG. 26 is a perspective view illustrating an inkjet recording apparatus according to a seventh embodiment.

FIG. 26 illustrates an inkjet recording apparatus according to the present embodiment. The recording apparatus 1000 according to the present embodiment differs from the first embodiment with regard to the point that full-color recording is performed on the recording medium by arraying four monochrome liquid discharge heads 3 in parallel, each corresponding to one of CMYK ink. Although the number of discharge orifice rows usable per color in the first embodiment was two rows, the number of discharge orifice rows usable per color in the present embodiment is 20 rows (FIG. 25A). This enables extremely high-speed recording to be performed, by allocating recording data to multiple discharge orifice rows and performing recording. Even if there are discharge orifices that exhibit ink defective discharge, reliability is improved by a discharge orifice at a corresponding position in the conveyance direction of the recording medium in another row performing discharge in a complementary manner, and accordingly the arrangement is suitable for industrial printing. The supply system of the recording apparatus 1000, the buffer tank 1003, and the main tank (ink tank) 1006 (FIG. 2) are connected to the liquid discharge heads 3 by fluid connection, in the same way as in the first embodiment. Each liquid discharge head 3 is also electrically connected to an electric control unit that transmits electric power and discharge control signals to the liquid discharge head 3.

Description of Structure of Liquid Discharge Head

Figure 20A:
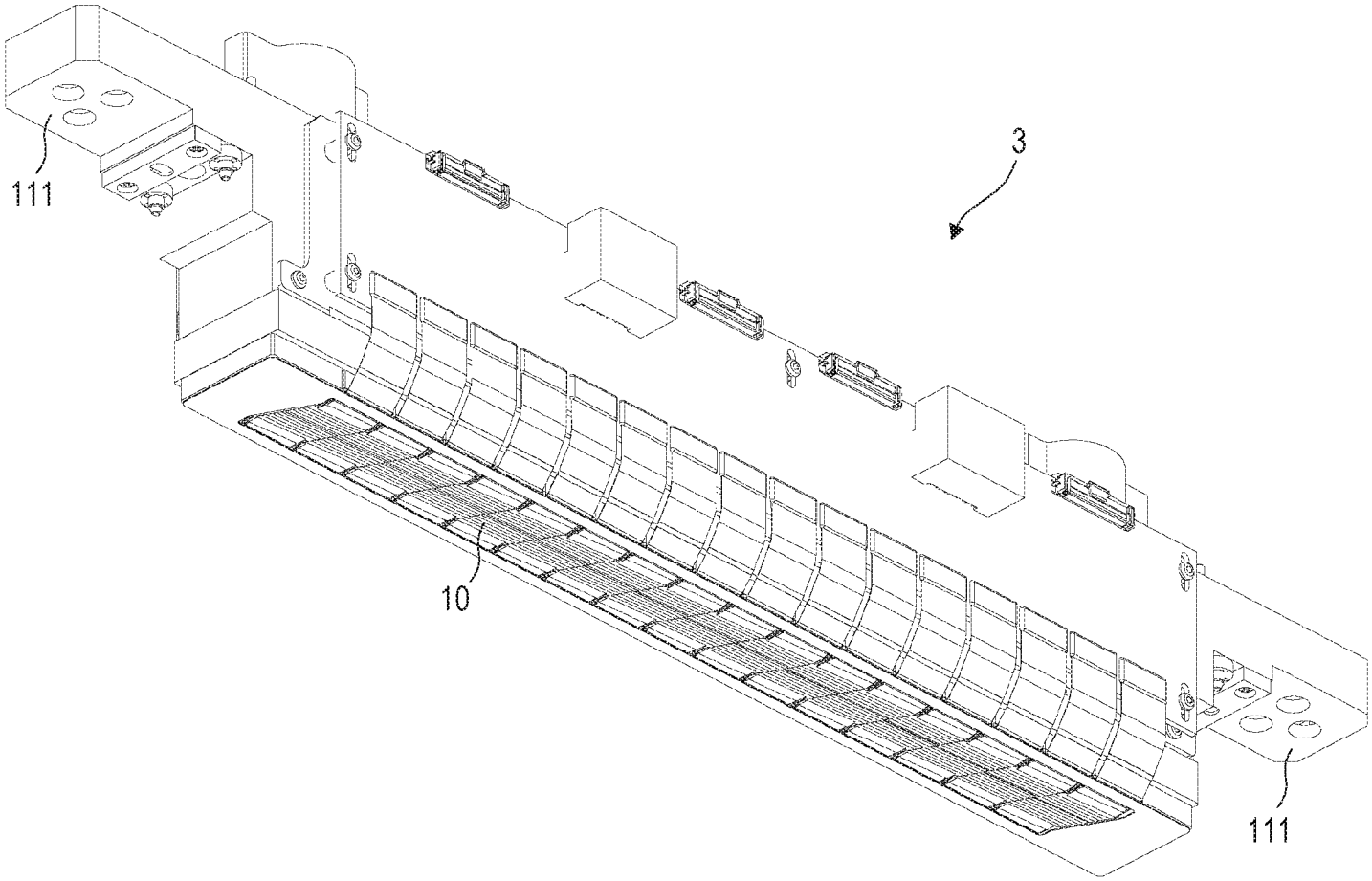
FIGS. 20A and 20B are perspective views of the liquid discharge head according to an exemplary embodiment.
Figure 20B:
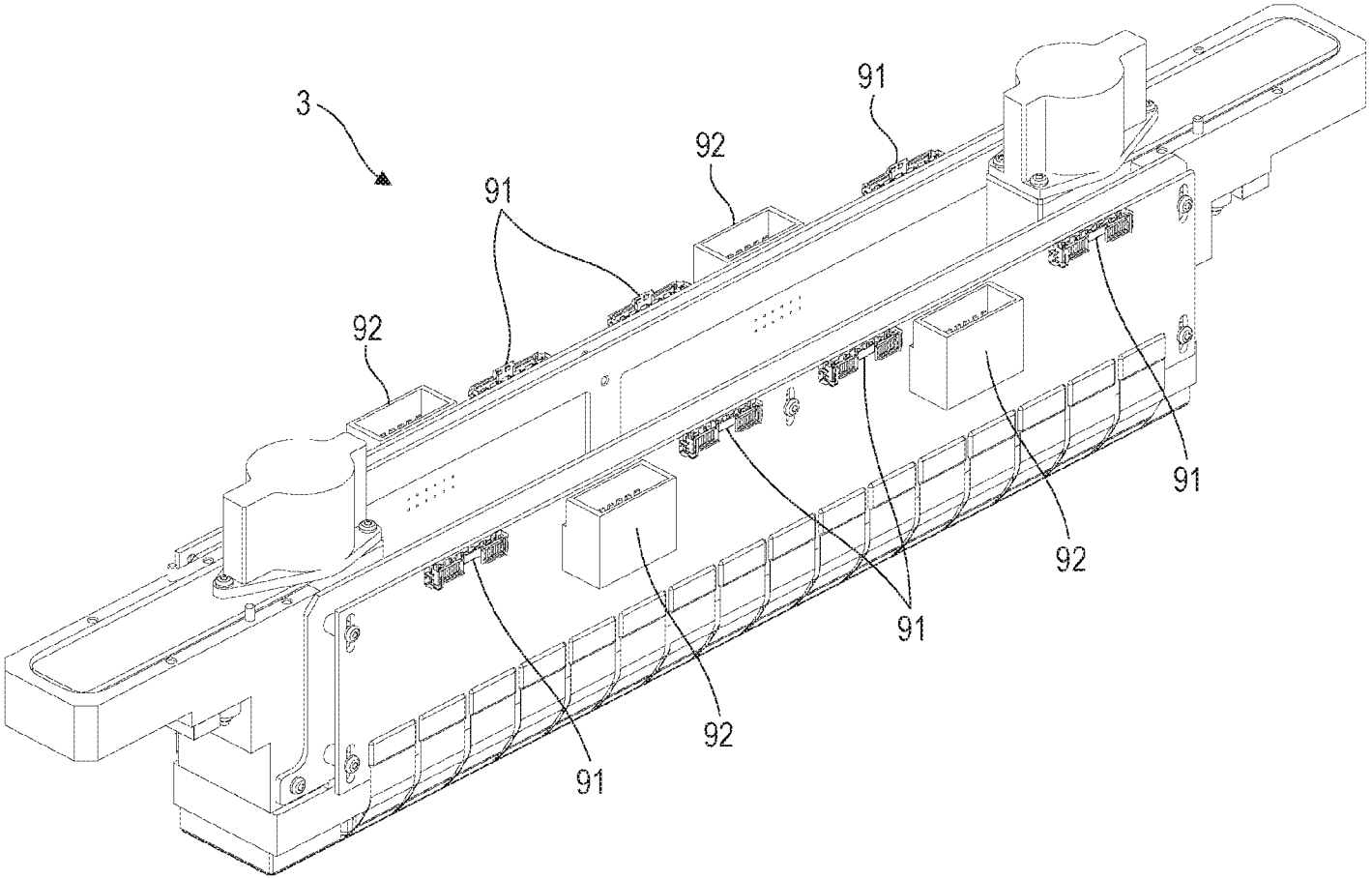

Description will be made regarding the structure of the liquid discharge head 3 according to the present embodiment. FIGS. 20A and 20B are perspective diagrams of the liquid discharge head 3 according to the present embodiment. The liquid discharge head 3 is a line type liquid discharge head that has 16 recording element boards 10 arrayed in a straight line in the longitudinal direction of the liquid discharge head 3. The liquid discharge head 3 has the liquid connection portions 111, signal input terminals 91, and power supply terminals 92 in the same way as the first embodiment. The liquid discharge head 3 according to the present embodiment differs from the first embodiment in that the input terminals 91 and power supply terminals 92 are disposed on both sides of the liquid discharge head 3, since the number of discharge orifice rows is greater. This is to reduce voltage drop and signal transmission delay that occurs at wiring portions provided to the recording element boards 10.

Figure 21:
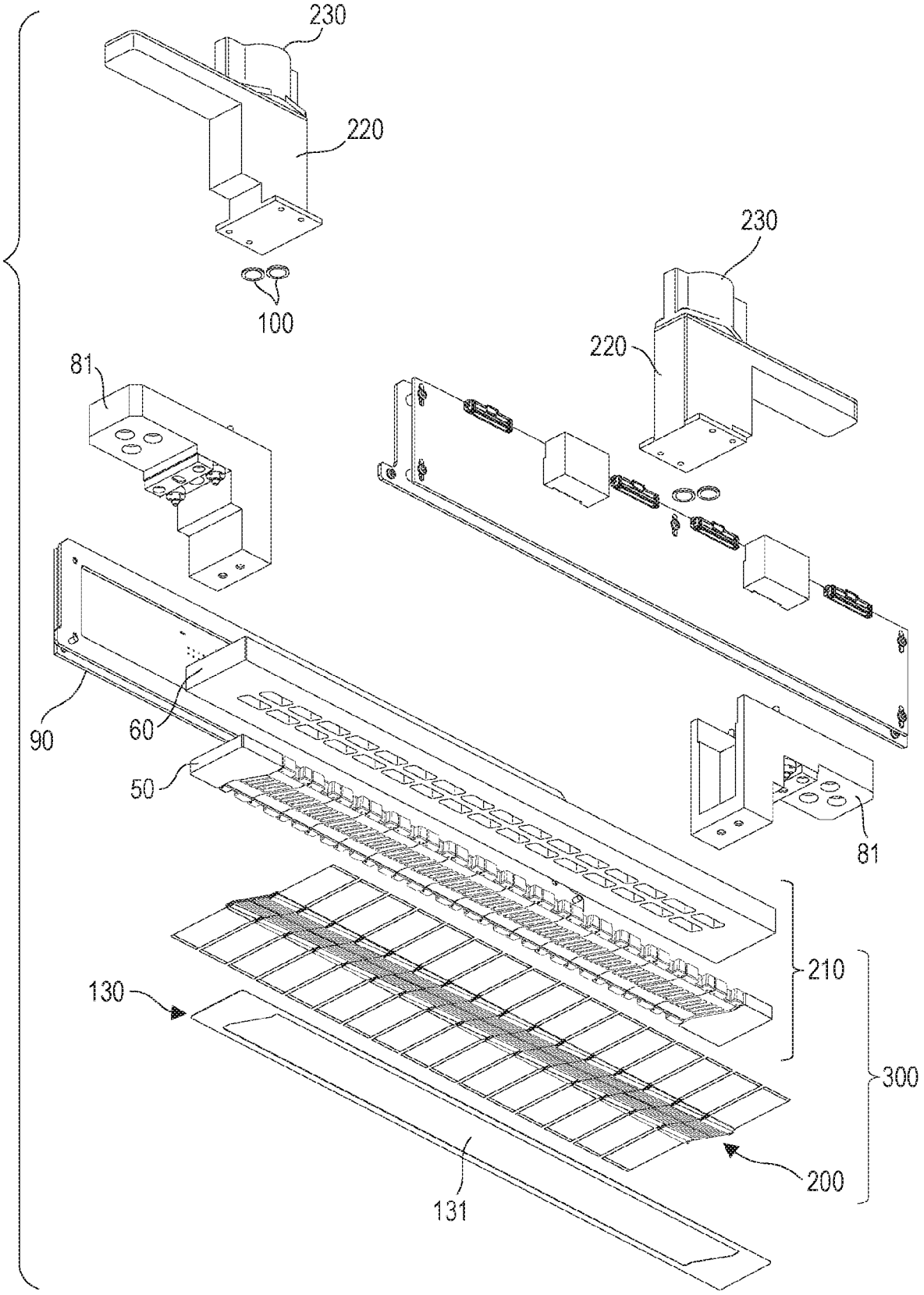
FIG. 21 is a disassembled perspective view of the liquid discharge head in FIGS. 20A and 20B.

FIG. 21 is a disassembled perspective view of the liquid discharge head 3, illustrating each part or unit making up the liquid discharge head 3 disassembled according to function. There are liquid discharge unit support members 81 connected to both ends of the second channel member 60 in the present embodiment. This liquid discharge unit 300 is mechanically enjoined to a carriage of the recording apparatus 1000, whereby the liquid discharge head 3 is positioned. Liquid supply units 220 having negative pressure control units 230, and the electric wiring board 90, are joined to the liquid discharge unit support members 81. Filters (omitted from illustration) are built into the two liquid supply units 220. The two negative pressure control units 230 are set to pressures that differ from each other, and are a negative pressure control unit 230 that is negative pressure but is relatively high pressure, and a negative pressure control unit 230 that is negative pressure and is relatively low pressure. When the high-pressure side and low-pressure side negative pressure control units 230 are disposed on the ends of the liquid discharge head 3 as illustrated in FIGS. 14A through 15, the flow of liquid on the common supply channel 211 and the common recovery channel 212 that extend in the longitudinal direction of the liquid discharge head 3 are mutually opposite. This promotes heat exchange between the common supply channel 211 and common recovery channel 212, so that the temperature difference between the two common channels can be reduced. This is advantageous in that temperature difference does not readily occur among the multiple recording element boards 10 disposed along the common channels, and consequently unevenness in recording due to temperature difference does not readily occur.

The channel member 210 of the liquid discharge unit 300 will be described in detail next. The channel member 210 is the first channel member 50 and second channel member 60 that have been laminated as illustrated in FIG. 21, and distributes liquid supplied from the liquid supply unit 220 to the discharge modules 200. The channel member 210 also serves as a channel member for liquid recirculating from the discharge modules 200 to the liquid supply unit 220. The second channel member 60 of the channel member 210 is a channel member in which the common supply channel 211 and common recovery channel 212 have been formed, and also primary undertakes the rigidity of the liquid discharge head 3. Accordingly, the material of the second channel member 60 preferably is sufficiently corrosion-resistant as to the liquid and has high mechanical strength. Examples of suitably-used materials include stainless steel, titanium (Ti), alumina, or the like.

Figure 22A:
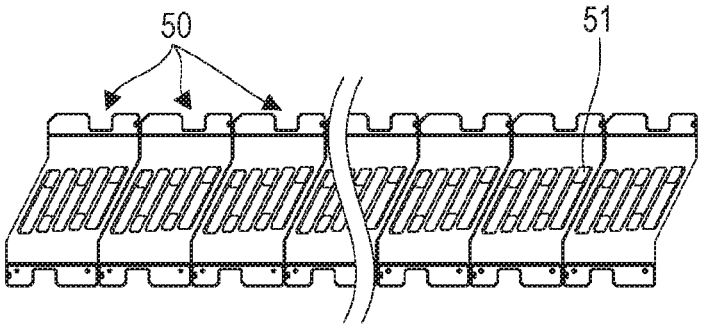
FIGS. 22A through 22E are plan and bottom views of channel members of the liquid discharge head in FIG. 20.
Figure 22B:
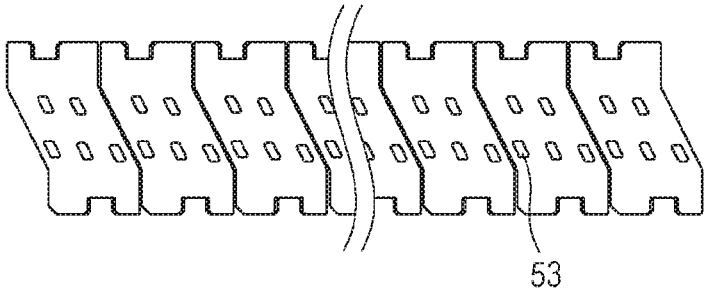
Figure 22C:
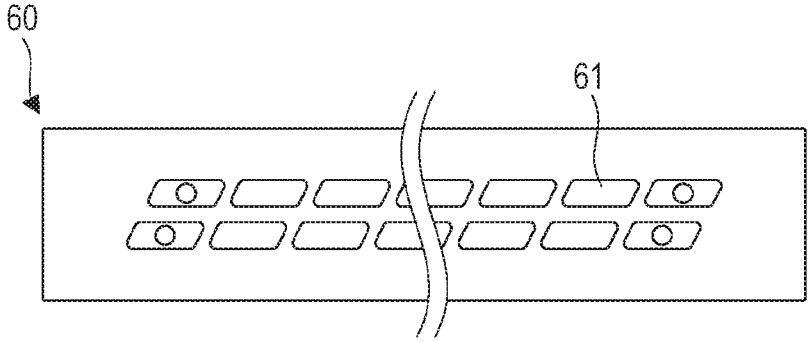
Figure 22D:
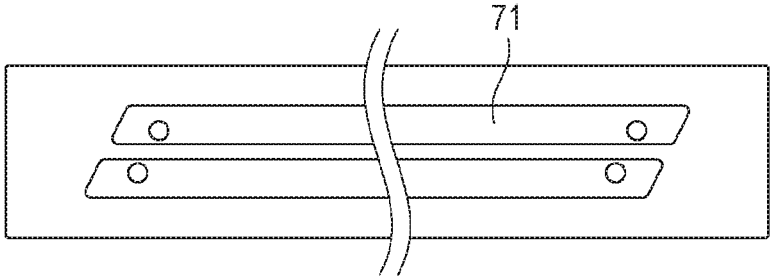
Figure 22E:
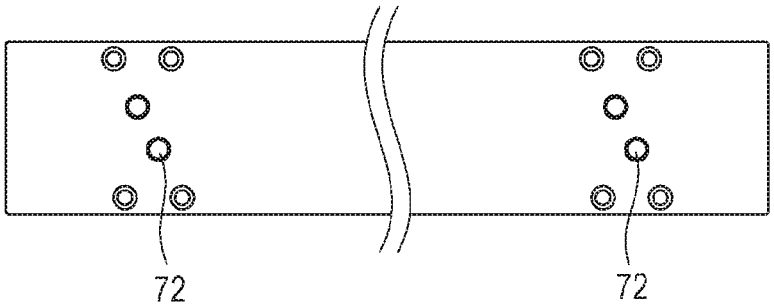

FIG. 22A illustrates the face of the first channel member 50 on the side where the discharge modules 200 are mounted, and FIG. 22B is a diagram illustrating the reverse face therefrom, that comes into contact with the second channel member 60. Unlike the case in the first embodiment, the first channel member 50 according to the seventh embodiment is an arrangement where multiple members corresponding to the discharge modules 200 are arrayed adjacently. Using this divided structure enables a length corresponding to the length of the liquid discharge head to be realized by arraying multiple modules, and accordingly can particularly be suitably used in relatively long-scale liquid discharge heads corresponding to sheets of B2 size and even larger, for example. The communication ports 51 of the first channel member 50 communicate with the discharge modules 200 by fluid connection as illustrated in FIG. 22A, and individual communication ports 53 of the first channel member 50 communicate with the communication ports 61 of the second channel member 60 by fluid connection as illustrated in FIG. 22B. FIG. 22C illustrates the face of the second channel member 60 that comes in contact with the first channel member 50, FIG. 22D illustrates a cross-section of the middle of the second channel member 60 taken in the thickness direction, and FIG. 22E is a diagram illustrating the face of the second channel member 60 that comes into contact with the liquid supply unit 220. The functions of the channels and communication ports of the second channel member 60 are the same as in with one color worth in the first embodiment. One of the common channel grooves 71 of the second channel member 60 is the common supply channel 211 illustrated in FIG. 23, and the other is the common recovery channel 212. Both have liquid supplied from one end side toward the other end side following the longitudinal direction of the liquid discharge head 3. Unlike the case in the first embodiment, the flow directions of ink for the common supply channel 211 and common recovery channel 212 are mutually opposite directions.

Figure 23:
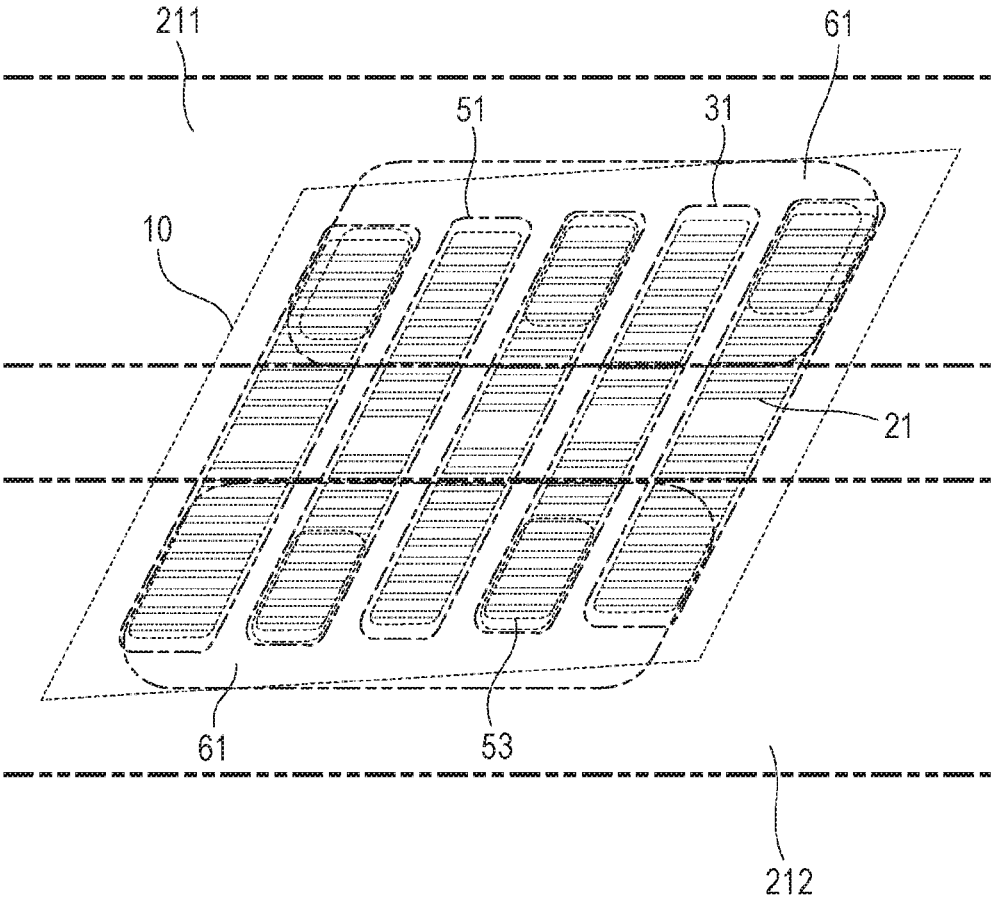
FIG. 23 is a diagram for describing connection states of the recording element board and channel members of the liquid discharge head in FIG. 20.

FIG. 23 is a transparent view illustrating the connection relationship regarding liquid between the recording element boards 10 and the channel member 210. The set of the common supply channel 211 and common recovery channel 212 extending in the longitudinal direction of the liquid discharge head 3 is provided within the channel member 210, as illustrated in FIG. 23. The communication ports 61 of the second channel member 60 are each positioned with and connected to the individual communication ports 53 of the first channel member 50, thereby forming a liquid supply path from the communication ports 72 of the second channel member 60 to the communication ports 51 of the first channel member 50 via the common supply channel 211. In the same way, a liquid supply path from the communication ports 72 of the second channel member 60 to the communication ports 51 of the first channel member 50 via the common recovery channel 212 is also formed.

Channels are formed on the discharge modules 200 and recording element boards 10 to communicate with the discharge orifices 13, so that part or all of the supplied liquid can recirculate through the discharge orifices 13 (pressure chambers 23) that are not performing discharging operations, in the same way as in the first embodiment. The common supply channel 211 is connected to the negative pressure control unit 230 (high-pressure side), and the common recovery channel 212 to the negative pressure control unit 230 (low-pressure side), via the liquid supply unit 220, in the same way as in the first embodiment. Accordingly, a flow is generated by the differential pressure thereof, that flows from the common supply channel 211 through the discharge orifices 13 (pressure chambers 23) of the recording element board 10 to the common recovery channel 212.

Description of Discharge Module

Figure 24A:
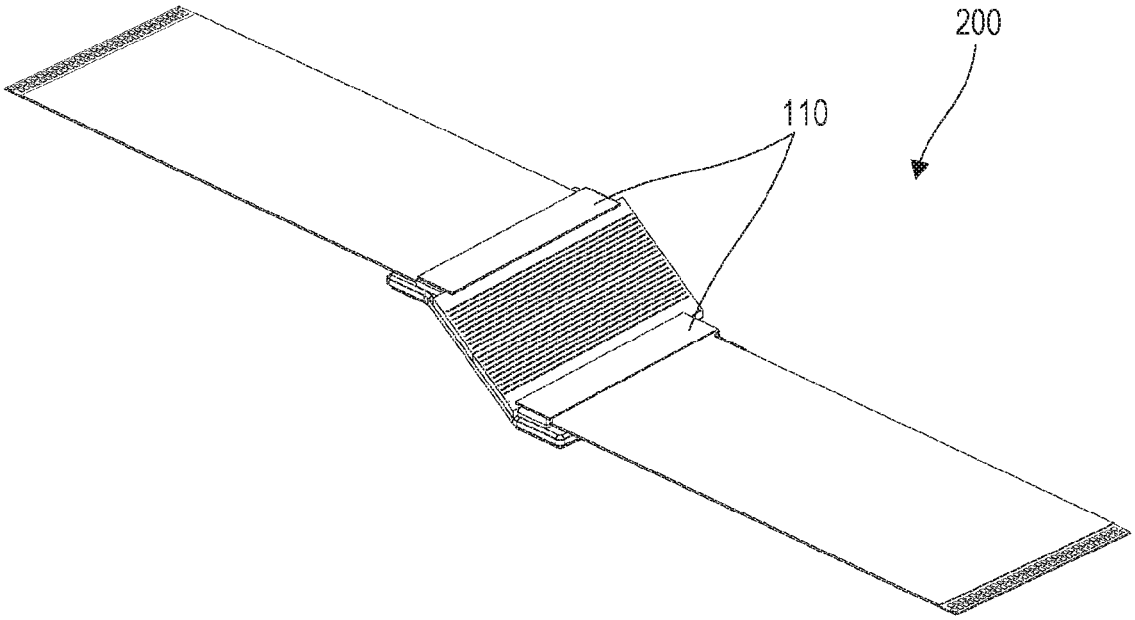
FIGS. 24A and 24B are diagrams illustrating a discharge module of the liquid discharge head in FIG. 20, FIG. 24A being a perspective view and FIG. 24B a disassembled view.
Figure 24B:
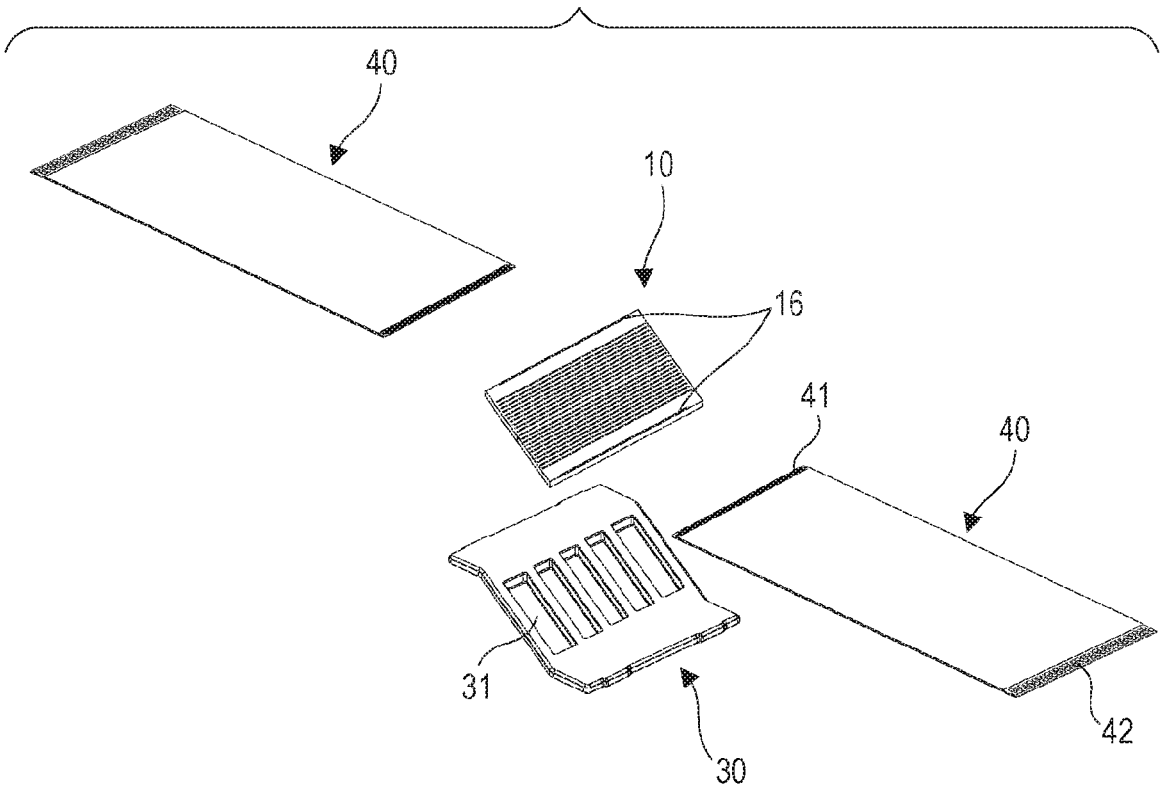

FIG. 24A is a perspective view of one discharge module 200, and FIG. 24B is a disassembled view thereof. The difference as to the first embodiment is the point that multiple terminals 16 are disposed arrayed on both sides (the long side portions of the recording element board 10) following the direction of the multiple discharge orifice rows of the recording element board 10, and that that two flexible printed circuit boards 40 are provided to one recording element board 10 and are electrically connected to the terminals 16. The reason is that the number of discharge orifice rows provided on the recording element board 10 is 20 rows, for example, which is a great increase over the eight rows in the first embodiment. The object thereof is to keep the maximum distance from the terminals 16 to the recording elements 15 provided corresponding to the discharge orifice row short, hereby reducing voltage drop and signal transmission delay that occurs at wiring portions provided to the recording element board 10. Liquid communication ports 31 of the support member 30 are opened so as to span all discharge orifice rows provided to the recording element board 10. Other points are the same as in the first embodiment.

Description of Structure of Recording Element Board

Figure 25B:
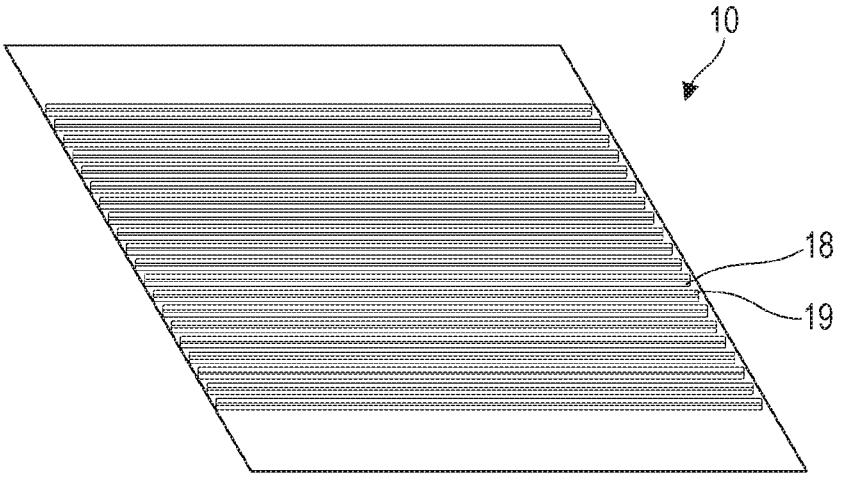
Figure 25C:
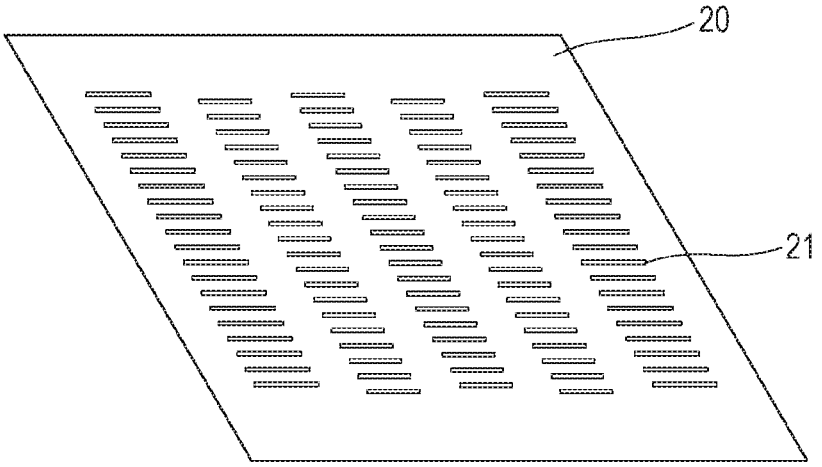

FIG. 25A is a schematic diagram illustrating the face of the recording element board 10 on the side where the discharge orifices 13 are disposed, and FIG. 25C is a schematic diagram illustrating the reverse face of that illustrated in FIG. 25A. FIG. 25B is a schematic diagram illustrating the face of the recording element board 10 in a state where the cover plate 20 provided on the rear face side of the recording element board 10 is removed in FIG. 25C. Liquid supply channels 18 and liquid recovery channels 19 are alternately provided on the rear face of the recording element board 10 following the discharge orifice row direction, as illustrated in FIG. 25B. Despite the number of discharge orifice rows being much greater than that in the first embodiment, a substantial difference from the first embodiment is that the terminals 16 are disposed on both side portions of the recording element board 10 following the discharge orifice row direction. The basic configuration is the same as that in the first embodiment, such as one set of a liquid supply channel 18 and liquid recovery channel 19 being provided for each discharge orifice row, openings 21 that communicate with the liquid communication ports 31 of the support member 30 being provided to the cover plate 20, and so forth.

Eighth Embodiment

The configuration of an inkjet recording apparatus 1000 and liquid discharge head 3 according to an eighth embodiment will be described. The liquid discharge head 3 according to the eighth embodiment is a page-wide head that records a B2 size recording medium sheet with a single scan. Points of difference of the eighth embodiment as to the above-described embodiments will primarily be described below, and portions that are the same will be omitted from description.

Description of Inkjet Recording Apparatus

Figure 27:
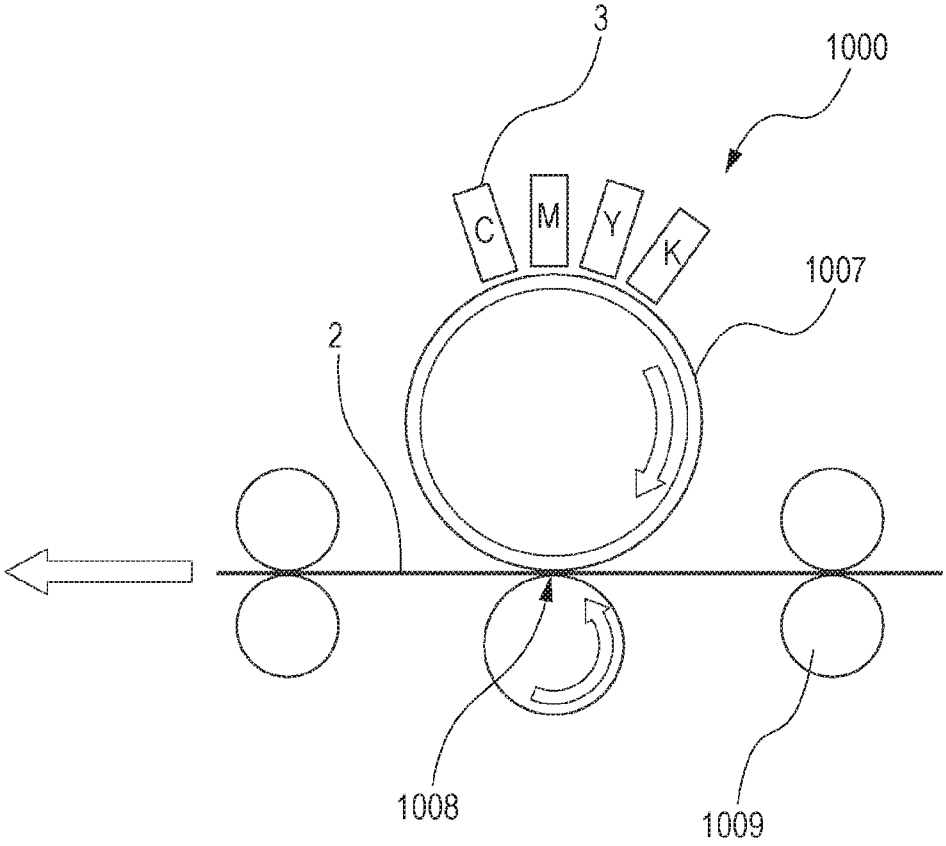
FIG. 27 is a perspective view illustrating an inkjet recording apparatus according to an eighth embodiment.

FIG. 27 is a schematic diagram of an inkjet recording apparatus according to the present embodiment. The recording apparatus 1000 is of a configuration that does not directly record on the recording medium from the liquid discharge head 3, but rather discharges liquid on an intermediate transfer member (intermediate transfer drum 1007) and forms an image, following which the image is transferred onto the recording medium 2. The recording apparatus 1000 has four monochrome liquid discharge heads 3 corresponding to the four types of ink of CMYK, disposed in an arc following the intermediate transfer drum 1007. Thus, full-color recording is performed on the intermediate transfer member, the recorded image is dried to a suitable state on the intermediate transfer member, and then transferred by a transfer unit 1008 onto the recording medium 2 conveyed by a sheet conveyance roller 1009. Whereas the sheet conveyance system in the above-described embodiments was horizontal conveyance with the intent of primarily conveying cut sheets, the present embodiment is capable of handling continuous sheets supplied from a main roll (omitted from illustration). This sort of drum conveyance system can easily convey sheets with a certain tension applied, so there is less conveyance jamming when performing high-speed recording. Thus, the reliability of the apparatus improves, and is suitable for application to business printing and the like. The supply system of the recording apparatus 1000, the buffer tank 1003, and the main tank 1006 are connected to the liquid discharge heads 3 by fluid connection. Each liquid discharge head 3 is also electrically connected to an electric control unit that transmits electric power and discharge control signals to the liquid discharge head 3.

Ninth Embodiment

Figure 28:
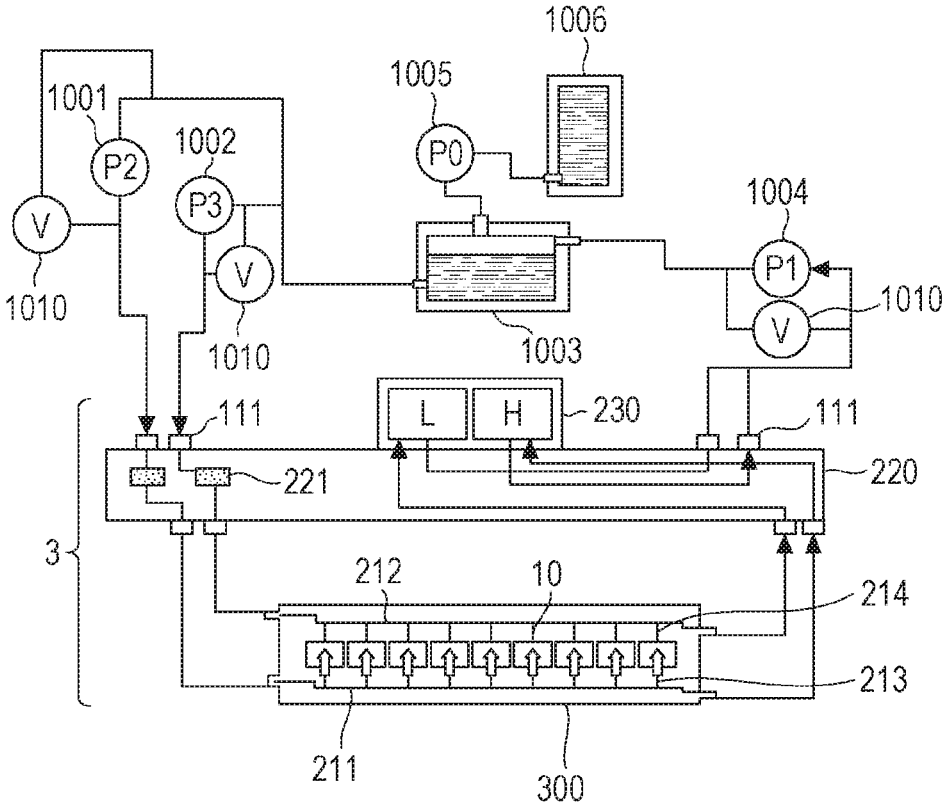
FIG. 28 is a diagram illustrating a liquid circulation path according to a ninth embodiment.

Although the circulation paths illustrated in FIGS. 2 and 9 between the tanks of the recording apparatus 1000 and the liquid discharge head 3 are applicable as a liquid circulation path, a circulation path illustrated in FIG. 28 is suitable. A primary difference as to the circulation paths described above is that bypass valves 1010 are added that communicate with channels of each of the first circulation pumps 1001 and 1002 and the second circulation pump 1004. The bypass valves 1010 function to lower pressure at the upstream side of the bypass valve 1010 (first function), due to the valve opening when pressure exceeds a preset pressure. The bypass valves 1010 also function to open and close valves at a predetermined timing by signals from a control board at the recording apparatus main unit (second function).

According to the first function, excessively large or excessively small pressure can be kept from being applied to the channel at the downstream side of the first circulation pumps 1001 and 1002 and the upstream side of the second circulation pump 1004. For example, in a case where the functions of the first circulation pumps 1001 and 1002 malfunction, excessive flow rate or pressure may be applied to the liquid discharge head 3. This may cause liquid to leak from the discharge orifices 13 of the liquid discharge head 3, or joined portions within the liquid discharge head 3 to be damaged. However, in a case where bypass valves are added to the first circulation pumps 1001 and 1002 as in the present embodiment, opening the bypass valves 1010 releases the liquid path to the upstream side of the circulation pumps, so trouble such as that described above can be suppressed, even if excessive pressure occurs.

Also, due to the second function, when stopping circulation operations, all bypass valves 1010 are quickly opened after the first circulation pumps 1001 and 1002 and second circulation pump 1004 stop, based on control signals from the main unit side. This allows the high negative pressure (e.g., several kPa to several tens of kPa) at the downstream portion of the liquid discharge head 3 (between the negative pressure control unit 230 and the second circulation pump 1004) to be released in a short time. In a case of using a positive-displacement pump such as a diaphragm pump as the circulation pump, a check valve usually is built into the pump. However, opening the bypass valves 1010 enables pressure release at the downstream side of the liquid discharge head 3 to be performed from the downstream buffer tank 1003 side as well. Although pressure release of the downstream side of the liquid discharge head 3 can be performed just from the upstream side as well, there is pressure drop in the channels at the upstream side of the liquid discharge head 3 and the channels within the liquid discharge head 3. Accordingly, there is the concern that pressure discharge may take time, the pressure within the common channel within the liquid discharge head 3 may temporarily drop too far, and the meniscus at the discharge orifices may be destroyed. Opening the bypass valves 1010 at the downstream side of the liquid discharge head 3 promotes pressure discharge at the downstream side of the liquid discharge head 3, so the risk of destruction of the meniscus at the discharge orifices is reduced.

Description of Structure of Liquid Discharge Head

Figure 29A:
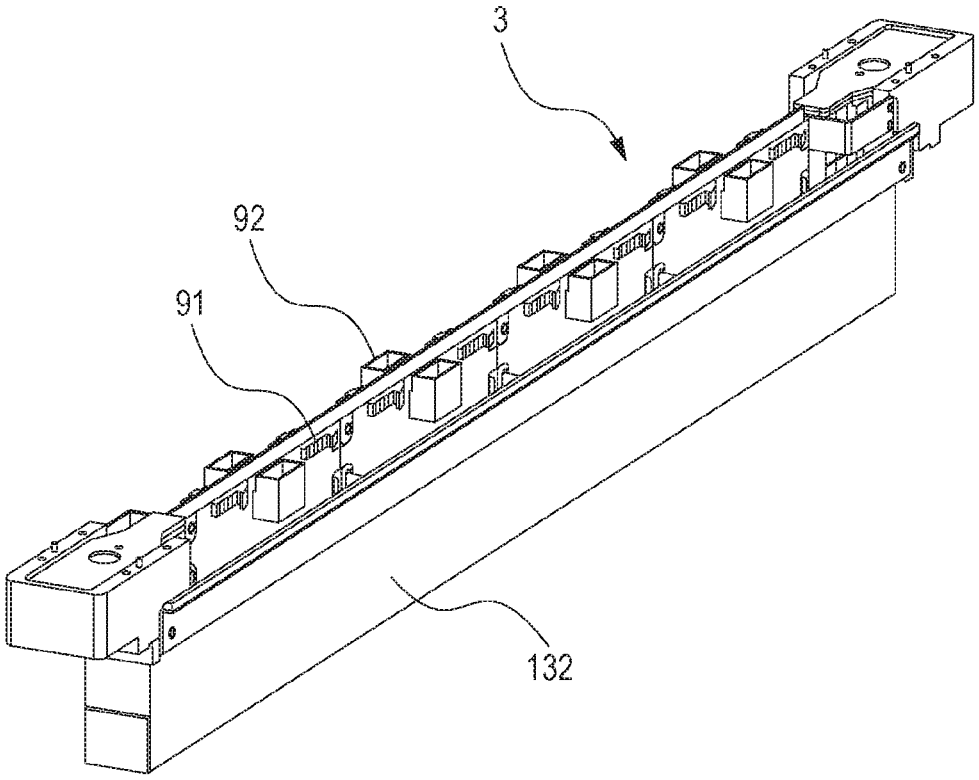
FIGS. 29A and 29B are diagrams illustrating a liquid discharge head according to a ninth embodiment.
Figure 29B:
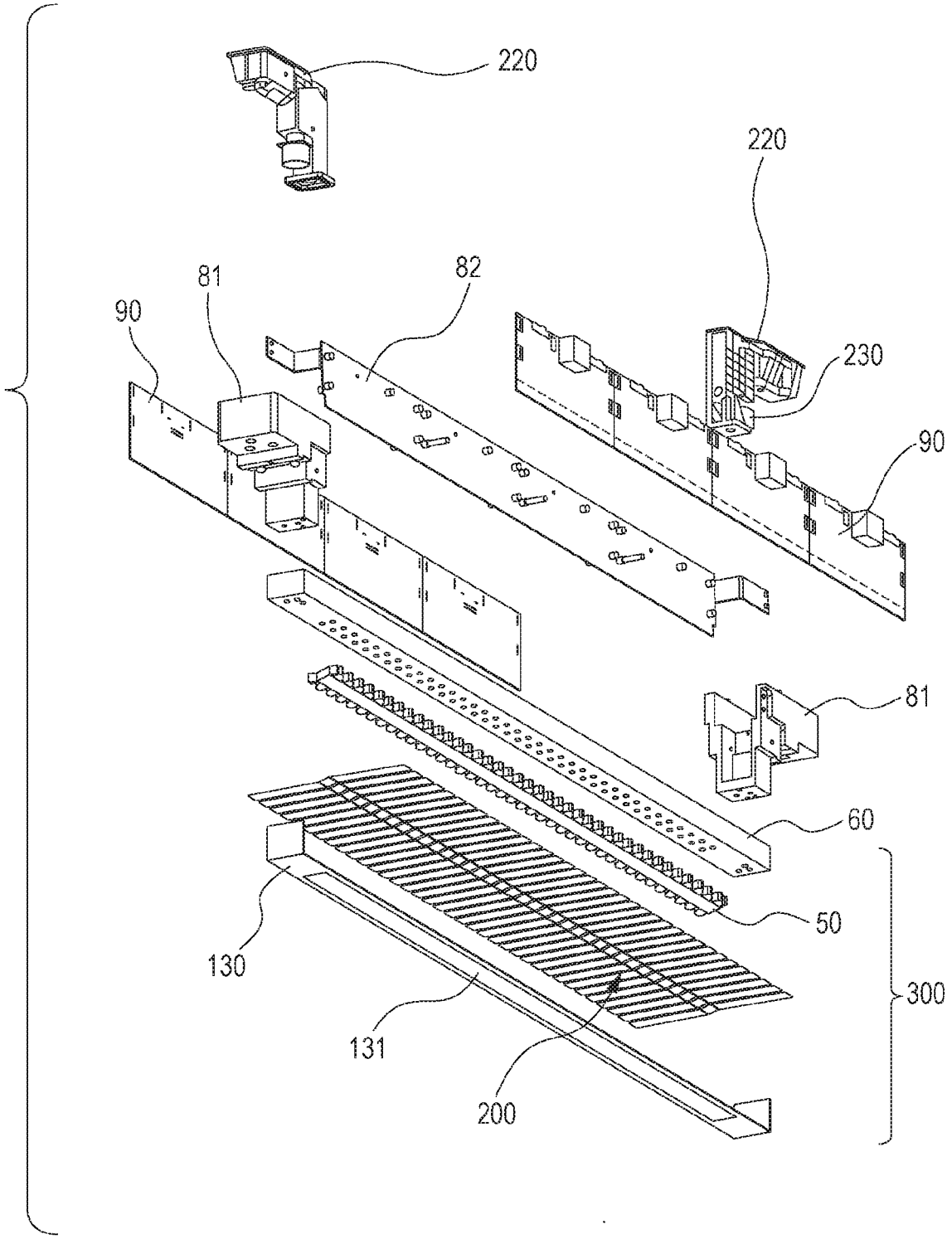

The structure of the liquid discharge head 3 according to a ninth embodiment will be described. FIG. 29A is a perspective view of the liquid discharge head 3 according to the present embodiment, and FIG. 29B is a disassembled perspective view thereof. The liquid discharge head 3 has 36 recording element boards 10 arrayed in a straight line (inline) in the longitudinal direction of the liquid discharge head 3, and is a line type (page-wide) inkjet recording head that records using a single-color liquid. The liquid discharge head 3 has the signal input terminals 91 and power supply terminals 92, and also is provided with a shield plate 132 to protect the longitudinal side face of the head.

FIG. 29B is a disassembled perspective view of the liquid discharge head 3, illustrating each part or unit making up the liquid discharge head 3 disassembled according to function (the shield plate 132 is omitted from illustration). The roles of the units and members, and the order of liquid flow through the liquid discharge head 3, are the same as in the embodiments described above. This differs primarily with regard to the points of the electric wiring board 90 being divided into a plurality and disposed, the position of the negative pressure control units 230, and the shape of the first channel member 50. In the case of a liquid discharge head 3 having a length corresponding to a B2 size recording medium for example, as in the case of the present embodiment, eight electric wiring boards 90 are provided since the amount of electric power the liquid discharge head 3 uses is great. Four each of the electric wiring boards 90 are attached to both sides of the slender electric wiring board support member 82 attached to the liquid discharge unit support member 81.

Figure 30A:
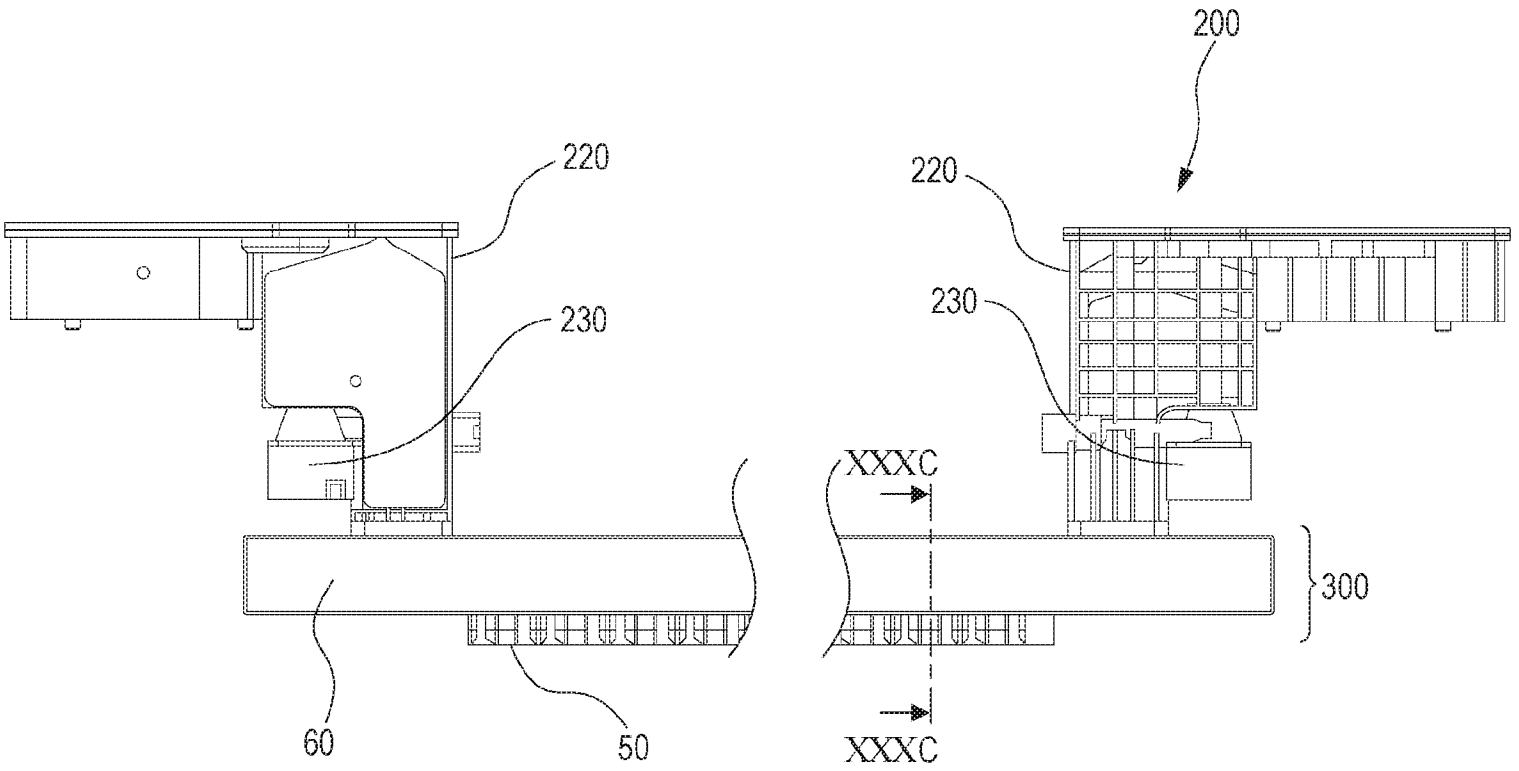
FIGS. 30A through 30C are diagrams illustrating a liquid discharge head according to the ninth embodiment.
Figure 30B:
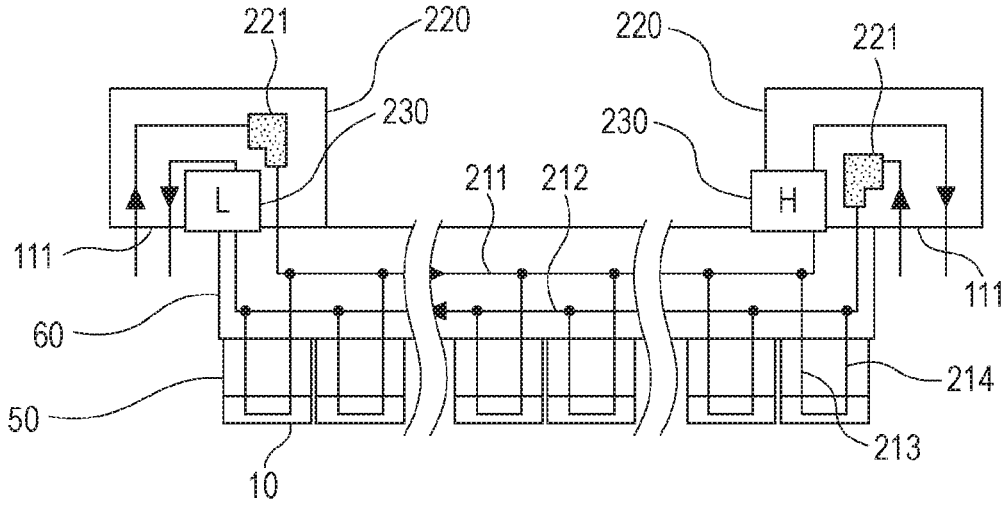
Figure 30C:
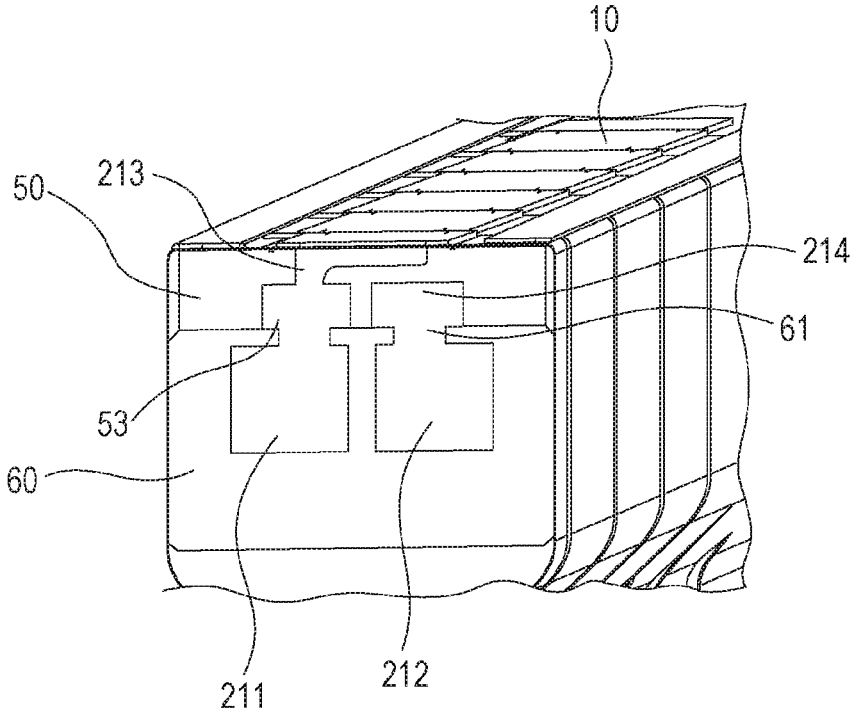

FIG. 30A is a side view of the liquid discharge head 3 that has the liquid discharge unit 300, liquid supply units 220, and negative pressure control units 230, FIG. 30B is a schematic diagram illustrating the flow of liquid, and FIG. 30C is a perspective view illustrating a cross-section taken along line XXXC-XXXC in FIG. 30A. Parts of the configuration have been simplified to facilitate understanding.

The liquid connection portions 111 and filters 221 are provided within the liquid supply units 220, with the negative pressure control units 230 being integrally formed beneath the liquid supply units 220. This enables the distance in the height direction between the negative pressure control units 230 and the recording element boards 10 to be reduced as compared to the above-described embodiments. This configuration reduces the number of channel connection portions within the liquid supply units 220, and is advantageous not only regarding improved reliability regarding leakage of recording liquid, but also in that the number of parts and assembly processes can be reduced.

Also, the water head difference between the negative pressure control units 230 and the face where the discharge orifices are formed is relatively smaller, and accordingly can be suitably applied to a recording apparatus where the inclination angle of the liquid discharge head 3 differs for each liquid discharge head 3, such as illustrated in FIG. 27. The reason is that the reduced water head difference enables the negative pressure difference applied to the discharge orifices of the respective recording element boards 10 can be reduced even if each of the multiple liquid discharge heads 3 is used at a different inclination angle. Reducing the distance from the negative pressure control units 230 to the recording element boards 10 also reduces the pressure drop difference due to fluctuation in flow of the liquid, since the flow resistance is reduced, and is preferable from the point that more stable negative pressure control can be performed.

FIG. 30B is a schematic diagram illustrating the flow of the recording liquid within the liquid discharge head 3. The circuitry is the same as the circulation path illustrated in FIG. 28, but FIG. 30B illustrates the flow of liquid at each component within the actual liquid discharge head 3. A set of the common supply channel 211 and common recovery channel 212 is provided within the slender second channel member 60, extending in the longitudinal direction of the liquid discharge head 3. The common supply channel 211 and common recovery channel 212 are configured so that the liquid flows in mutually opposite directions, with filters 221 disposed at the upstream side of these channels to trap foreign substances intruding from the connection portions 111 or the like. This arrangement where the liquid flows in mutually opposite directions in the common supply channel 211 and common recovery channel 212 is preferable from the point that the temperature gradient in the longitudinal direction within the liquid discharge head 3 is reduced. The flow direction of the common supply channel 211 and common recovery channel 212 is shown as being in the same direction in FIG. 28 to simplify explanation.

A negative pressure control unit 230 is disposed at the downstream side of each of the common supply channel 211 and common recovery channel 212. The common supply channel 211 has branching portions to multiple branch supply channels 213 along the way, and the common recovery channel 212 has branching portions to multiple branch recovery channels 214 along the way. The branch supply channels 213 and branch recovery channels 214 are formed within multiple first channel members 50. Each of the branch channels communicates with openings 21 (see FIG. 13C) of the cover plate 20 provided to the reverse face of the recording element boards 10.

The negative pressure control units 230 indicated by H and L in FIG. 30B are high-pressure side (H) and low-pressure side (L) units. The respective negative pressure control units 230 are back-pressure type pressure adjustment mechanisms, set to control the pressure upstream of the negative pressure control units 230 to relatively high (H) and low (L) negative pressures. The common supply channel 211 is connected to the negative pressure control unit 230 (high-pressure side), and the common recovery channel 212 is connected to the negative pressure control unit 230 (low-pressure side). This generates differential pressure between the common supply channel 211 and common recovery channel 212. This differential pressure causes the liquid to flow from the common supply channel 211, through the branch supply channels 213, discharge orifices 13 (pressure chambers 23) within the recording element boards 10, and the branch recovery channels 214 is that order, and to the common recovery channel 212.

FIG. 30C is a perspective view illustrating a cross-section taken along line XXXC-XXXC in FIG. 30A. Each discharge module 200 in the present embodiment is configured including a first channel member 50, recording element boards 10, and flexible printed circuit boards 40. The present embodiment does not have the support member 30 (FIG. 8) described in the embodiments above, with the recording element boards 10 having the cover plate 20 being directly joined to the first channel member 50. The common supply channel 211 provided to the second channel member 60 supplies liquid from the communication ports 61 provided on the upper face thereof to the branch supply channels 213, via the individual communication ports 53 formed on the lower face of the first channel member 50. Thereafter, the liquid passes through the pressure chambers 23, and is recovered to the common recovery channel 212 via the branch recovery channels 214, individual communication ports 53, and communication ports 61, in that order.

Unlike the arrangement illustrated in the above-described embodiments, the individual communication ports 53 on the lower face of the first channel member 50 (the face toward the second channel member 60) are openings of a sufficient size with regard to the communication ports 61 formed on the upper face of the second channel member 60. According to this configuration, even in a case where there is positional deviation at the time of mounting the discharge module 200 to the second channel member 60, fluid communication can be realized in a sure manner between the first channel member 50 and the second channel member 60, so yield will improve when manufacturing the head, thereby reducing costs.

Although two pressure adjustment mechanisms and flow resistance members have been given as pressure difference generating sources in the present specification described above, other configurations may be used as long as in accordance with the sprit of the present invention. Although the configuration where the channel resistance is higher than other portions is disclosed as being a permanent arrangement, an arrangement where the channel resistance can be changed to the higher at a timing where an issue is to be resolved is also effective.

Although the present disclosure is applicable to liquid discharge heads using various types of discharge arrangements (e.g., piezoelectric elements, heat-generating elements, and electrostatic systems), the present disclosure is particularly well-suited for application to liquid discharge heads where resistance in channel portions in the liquid discharge head (the pressure chambers 23 and the channels 24 communicating therewith). For example, the present disclosure can be suitably applied to liquid discharge heads where the height h of the channels 24 communicating with the pressure chamber 23 is 8 μm or lower. The present disclosure also is well-suited for application to full-line type liquid discharge heads where multiple recording element boards 10 are arrayed, having high-density discharge orifices where the array density of discharge orifices is 600 dpi or higher.

The present invention is not restricted by the above-described embodiments; rather, various alterations and modifications can be made without departing from the spirit and scope of the present invention. Accordingly, the scope of the present invention is defined by the accompanying Claims.

According to the present disclosure, liquid can be supplied in a liquid discharge head while suppressing increase in pressure drop.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002950, filed Jan. 8, 2016 and No. 2016-239370 filed Dec. 9, 2016, which are hereby incorporated by reference herein in their entirety.

What is claimed is:

1. A liquid discharge head comprising:

a plurality of discharge orifices configured to discharge liquid;

a plurality of recording elements configured to generate energy used to discharge liquid;

a plurality of supply channels configured to supply liquid to the plurality of recording elements;

a common supply channel communicating with the plurality of supply channels and configured to supply liquid to the plurality of supply channels;

a plurality of recovery channels configured to recover liquid supplied to the plurality of recording elements by the plurality of supply channels; and a common recovery channel communicating with the plurality of recovery channels and configured to recover liquid from the plurality of recovery channels, wherein the liquid discharge head has formed therein a first inlet port configured to supply liquid from outside of the liquid discharge head to the common supply channel, and a first recovery port configured to recover liquid from the common supply channel to the outside of the liquid discharge head, the first inlet port and the first recovery port communicating by the common supply channel without going through channel portions where the recording elements are disposed, and wherein the liquid discharge head has formed therein a second inlet port configured to supply liquid from outside of the liquid discharge head to the common recovery channel, and a second recovery port configured to recover liquid from the common recovery channel to the outside of the liquid discharge head, the second inlet port and the second recovery port communicating by the common recovery channel without going through channel portions where the recording elements are disposed.

2. The liquid discharge head according to claim 1, wherein the liquid within the common supply channel is supplied to the common recovery channel via the supply channels, channel portions where the recording elements are disposed, and the recovery channels, in that order.

3. The liquid discharge head according to claim 1, wherein the channel portions where the recording elements are disposed face the discharge orifices, and include pressure chambers internally accommodating the recording elements.

4. The liquid discharge head according to claim 1, wherein the plurality of supply channels extend in a direction orthogonal to a direction in which the common supply channel extends, and the plurality of recovery channels extend in a direction orthogonal to a direction in which the common recovery channel extends.

5. The liquid discharge head according to claim 1, wherein the common supply channel and the common recovery channel extend alongside each other.

6. The liquid discharge head according to claim 1, wherein the direction of flow of the liquid flowing through the common supply channel and the liquid flowing through the common recovery channel is the same.

7. The liquid discharge head according to claim 1, wherein the direction of flow of the liquid flowing through the common supply channel and the liquid flowing through the common recovery channel is different.

8. The liquid discharge head according to claim 1, wherein a static pressure value of liquid near the inlet port of the common supply channel is larger than a static pressure value near the inlet port of the common recovery channel, and wherein a static pressure value near the recovery port of the common supply channel is larger than a static pressure value near the recovery port of the common recovery channel.

9. The liquid discharge head according to claim 1, wherein the total amount of liquid supplied to the common supply channel and the common recovery channel is greater than the total sum of liquid discharged from all of the discharge orifices.

10. The liquid discharge head according to claim 9, wherein the flow rate flowing through the common supply channel per unit time is greater than the flow rate flowing through the common recovery channel per unit time.

11. The liquid discharge head according to claim 9, wherein the flow rate flowing through the common recovery channel per unit time is greater than the flow rate flowing through the common supply channel per unit time.

12. The liquid discharge head according to claim 1, wherein the liquid discharge head includes a recording element board that includes the recording elements, and a support member configured to support the recording element board, and wherein the common supply channel, the supply channels, the common recovery channel, and the recovery channels, are formed on the support member.

13. The liquid discharge head according to claim 12, wherein a rate of thermal spread of the support member is smaller than a rate of thermal spread of the recording element board.

14. The liquid discharge head according to claim 1, wherein the liquid discharge head includes a recording element board that includes the recording elements, and a support member configured to support the recording element board, and wherein the support member includes a first support member on which the supply channels and the recovery channels are formed, and a second support member on which the common supply channel and the common recovery channel are formed.

15. The liquid discharge head according to claim 14, wherein a rate of thermal spread of the at least the first support member of the support member having a laminated configuration is smaller than a rate of thermal spread of the recording element board.

16. The liquid discharge head according to claim 1, wherein a height of a channel adjacent to a pressure chamber having the recording element within is 8 μm or lower.

17. The liquid discharge head according to claim 1, wherein the liquid discharge head is a line-type liquid discharge head having a length corresponding to a recording medium.

18. The liquid discharge head according to claim 1, wherein liquid within a pressure chamber having the recording elements within is circulated between the inside of the pressure chamber and the outside of the pressure chamber.

19. The liquid discharge head according to claim 1, further comprising:

a first negative pressure control unit communicating with the common supply channel, and a second negative pressure control unit communicating with the common recovery channel.

20. A liquid discharge head comprising:

a recording element board including:

a plurality of discharge orifices configured to discharge liquid, a plurality of pressure chambers having recording elements within to discharge liquid from the discharge orifices, a plurality of first common channels configured to supply liquid to the plurality of pressure chambers, and a plurality of second common channels configured to recover liquid from the plurality of pressure chambers;

a plurality of supply channels communicating with the first common channel;

a plurality of recovery channels communicating with the second common channel;

a common supply channel in fluid connection with the plurality of supply channels; and a common recovery channel in fluid connection with the plurality of recovery channels, wherein the liquid discharge head has formed therein a first inlet port configured to supply liquid to the common supply channel, a first recovery port configured to recover liquid from the common supply channel, a second inlet port configured to supply liquid to the common recovery channel, and a second recovery port configured to recover liquid from the common recovery channel.

21. The liquid discharge head according to claim 20, wherein the first inlet port and the first recovery port communicate by the common supply channel without going through the pressure chamber, and wherein the second inlet port and the second recovery port communicate by the common recovery channel without going through the pressure chamber.

22. The liquid discharge head according to claim 20, further comprising:

a support member configured to support a plurality of the recording element boards, the plurality of recording element boards being arrayed on the support member, wherein the plurality of supply channels, the plurality of recovery channels, the common supply channel, and the common recovery channel, are provided on the support member.

23. The liquid discharge head according to claim 20, further comprising:

a first negative pressure control unit communicating with the common supply channel, and a second negative pressure control unit communicating with the common recovery channel.

24. A liquid discharge apparatus comprising:

a liquid discharge head including:

a plurality of discharge orifices configured to discharge liquid, a plurality of pressure chambers having a plurality of recording elements within, used to generate energy to discharge liquid, a first common channel communicating with a first inlet port and a first recovery port, a plurality of first individual channels communicating with the first common channel and configured to supply liquid to the plurality of recording elements, a second common channel communicating with a second inlet port and a second recovery port, and a plurality of second individual channels communicating with the second common channel and configured to recover liquid in the pressure chambers to the second common recovery channel; and a supply unit configured to supply liquid to the first common channel, the first individual channels, the plurality of recording elements, the second individual channels, and the second common channel, in that order, wherein the first inlet port and the first recovery port communicate by the first common channel without going through the pressure chamber, and the second inlet port and the second recovery port communicate by the second common channel without going through the pressure chamber.

25. The liquid discharge apparatus according to claim 24, wherein the pressure chambers face the discharge orifices.

26. The liquid discharge apparatus according to claim 25, further comprising:

a first negative pressure control unit communicating with the first inlet port; and a second negative pressure control unit communicating with the second inlet port.

27. The liquid discharge apparatus according to claim 24, further comprising:

a first liquid feed pump communicating with the first and second inlet ports, and configured to feed liquid;

a first recovery pump communicating with the first recovery port, and configured to recover liquid; and a second recovery pump communicating with the second recovery port, and configured to recover liquid.

28. The liquid discharge apparatus according to claim 24, further comprising:

a first liquid feed pump communicating with the first inlet port, and configured to feed liquid;

a second liquid feed pump communicating with the second inlet port, and configured to feed liquid;

a first recovery pump communicating with the first recovery port, and configured to recover liquid; and a second recovery pump communicating with the second recovery port, and configured to recover liquid.

29. The liquid discharge apparatus according to claim 24, further comprising:

a first liquid feed pump communicating with the first inlet port, and configured to feed liquid;

a second liquid feed pump communicating with the second inlet port, and configured to feed liquid; and a first recovery pump communicating with the first and second recovery ports, and configured to recover liquid.

30. The liquid discharge apparatus according to claim 24, further comprising:

a first liquid feed pump communicating with the first and second inlet ports, and configured to feed liquid; and a first recovery pump communicating with the first and second recovery ports, and configured to recover liquid.

31. The liquid discharge apparatus according to claim 24, further comprising:

an ink tank communicating with the first negative pressure control unit and the second negative pressure control unit.

32. A liquid discharge head comprising:

a recording element board including:

a plurality of discharge orifices configured to discharge liquid, a plurality of pressure chambers having recording elements within to discharge liquid from the discharge orifices, a plurality of first common channels configured to supply liquid to the plurality of pressure chambers, and a plurality of second common channels configured to recover liquid from the plurality of pressure chambers;

a plurality of supply channels communicating with the first common channel;

a plurality of recovery channels communicating with the second common channel;

a common supply channel in fluid connection with the plurality of supply channels;

a common recovery channel in fluid connection with the plurality of recovery channels;

an inlet port configured to supply liquid to the liquid discharge head; and a recovery port configured to recover liquid from the liquid discharge head, wherein the inlet port communicates with one end side of the common supply channel and one end side of the common recovery channel, wherein the inlet port communicates with the other end side of the common supply channel and the other end side of the common recovery channel, wherein flow resistance at the one end side of the common recovery channel is greater than flow resistance at the one end side of the common supply channel, and wherein flow resistance at the other end side of the common supply channel is greater than flow resistance at the other end side of the common recovery channel.

33. The liquid discharge head according to claim 32, further comprising:

a first negative pressure control unit communicating with the common supply channel, and a second negative pressure control unit communicating with the common recovery channel.

34. A liquid discharge method of discharging liquid from a liquid discharge head that includes a plurality of discharge orifices configured to discharge liquid, a plurality of pressure chambers internally having a plurality of recording elements configured to generate energy used to discharge liquid, a plurality of supply channels configured to supply liquid to the plurality of recording elements, a common supply channel configured to supply liquid to the plurality of supply channels, a plurality of recovery channels configured to recover liquid supplied to the plurality of recording elements by the plurality of supply channels, a common recovery channel configured to recover liquid from the plurality of recovery channels, a first inlet port configured to supply liquid from outside of the liquid discharge head to the common supply channel, a first recovery port configured to recover liquid from the common supply channel to the outside of the liquid discharge head, a second inlet port configured to supply liquid from outside of the liquid discharge head to the common recovery channel, and a second recovery port configured to recover liquid from the common recovery channel to the outside of the liquid discharge head, the method comprising:

recovering liquid that has flowed from the first inlet port into the common supply channel to the outside of the liquid discharge head from the first recovery port, and also recovering liquid that has flowed from the second inlet port into the common recovery channel to the outside of the liquid discharge head from the second recovery port; and discharging liquid from the discharge orifices in a state where supply of liquid is being performed in the recovering.

35. The liquid discharge method according to claim 34, wherein liquid is discharged from the discharge orifices in a state where a flow of liquid is being formed inside the pressure chambers in the recovering.

36. The liquid discharge method according to claim 34, wherein pressure of liquid flowing through the common supply channel is greater than pressure of liquid flowing through the common recovery channel.

37. The liquid discharge method according to claim 34, wherein liquid recovered from the first recovery port does not go through the pressure chambers.

* * * * *